US009429294B2

(12) United States Patent
Romeu et al.

(10) Patent No.: US 9,429,294 B2
(45) Date of Patent: Aug. 30, 2016

(54) SYSTEM FOR DIRECTIONAL CONTROL OF LIGHT AND ASSOCIATED METHODS

(71) Applicant: LIGHTING SCIENCE GROUP CORPORATION, Satellite Beach, FL (US)

(72) Inventors: Ricardo Romeu, Melbourne, FL (US); Mark Penley Boomgaarden, Satellite Beach, FL (US); Ryan Kelley, Denver, CO (US); Eric Holland, Indian Harbour Beach, FL (US)

(73) Assignee: Lighting Science Group Corporation, Cocoa Beach, FL (US)

( * ) Notice: Subject to any disclaimer, the term of this patent is extended or adjusted under 35 U.S.C. 154(b) by 296 days.

(21) Appl. No.: 14/076,621

(22) Filed: Nov. 11, 2013

(65) Prior Publication Data

US 2015/0131281 A1 May 14, 2015

(51) Int. Cl.

| | |
|---|---|
| ***F21V 5/04*** | (2006.01) |
| ***F21V 5/00*** | (2015.01) |
| *F21K 99/00* | (2016.01) |
| *F21Y 101/02* | (2006.01) |
| *F21Y 111/00* | (2016.01) |

(52) U.S. Cl.

CPC ..... *F21V 5/007* (2013.01); *F21K 9/30* (2013.01); *F21Y 2101/02* (2013.01); *F21Y 2111/007* (2013.01)

(58) Field of Classification Search

CPC ..... F21V 5/045; F21V 5/007; F21V 7/048; F21V 3/02; F21V 3/049; F21V 13/02; F21V 9/00; F21K 9/50; F21Y 2111/007

See application file for complete search history.

(56) References Cited

U.S. PATENT DOCUMENTS

| | | | |
|---|---|---|---|
| 5,057,908 | A | 10/1991 | Weber |
| 5,523,878 | A | 6/1996 | Wallace et al. |
| 5,704,701 | A | 1/1998 | Kavanagh et al. |
| 5,997,150 | A | 12/1999 | Anderson |

(Continued)

FOREIGN PATENT DOCUMENTS

| | | |
|---|---|---|
| EP | 1950491 | 7/2008 |
| EP | 2410240 | 1/2012 |

(Continued)

OTHER PUBLICATIONS

U.S. Appl. No. 13/739,054, filed Jan. 2013, Boomgaarden et al.

(Continued)

*Primary Examiner* — Julie Bannan

(74) *Attorney, Agent, or Firm* — Mark Malek; Stephen Bullock; Widerman Malek, PL

(57) ABSTRACT

A lighting device for emitting light in selective directions including a light source structure member, a plurality of lighting devices attached to the light source structure member, a controller, a power supply, and an optic carried by the light source structure member and including a plurality of facets. Each light source of the plurality of light sources may be positioned such that light emitted thereby is emitted through a facet of the plurality of facets of the first optic. Each facet of the plurality of facets may be configured to redirect light in a direction that is unique from the other facets of the plurality of facets. Additionally, the controller may be configured to selectively operate each light source of the plurality of light sources. Multiple pairs, or combinations, of light source structure members and optics may be included.

21 Claims, 10 Drawing Sheets

(56) References Cited

U.S. PATENT DOCUMENTS 6,140,646 A 10/2000 Busta et al.
6,290,382 B1 9/2001 Bourn et al.
6,341,876 B1 1/2002 Moss et al.
6,356,700 B1 3/2002 Strobl
6,370,168 B1 4/2002 Spinelli
6,542,671 B1 4/2003 Ma et al.
6,561,656 B1 5/2003 Kojima et al.
6,594,090 B2 7/2003 Kruschwitz et al.
6,647,199 B1 11/2003 Pelka et al.
6,707,611 B2 3/2004 Gardiner et al.
6,733,135 B2 5/2004 Dho
6,767,111 B1 7/2004 Lai
6,787,999 B2 9/2004 Stimac et al.
6,793,374 B2 * 9/2004 Begemann ..... F21K 9/135 362/219.01
6,799,864 B2 10/2004 Bohler et al.
6,817,735 B2 11/2004 Shimizu et al.
6,870,523 B1 3/2005 Ben-David et al.
6,871,982 B2 3/2005 Holman et al.
6,893,140 B2 5/2005 Storey et al.
6,945,672 B2 9/2005 Du et al.
6,948,838 B2 * 9/2005 Kunstler ..... F21S 48/215 362/237
6,964,501 B2 11/2005 Ryan
6,967,761 B2 11/2005 Starkweather et al.
6,974,713 B2 12/2005 Patel et al.
7,042,623 B1 5/2006 Huibers et al.
7,070,281 B2 7/2006 Kato
7,072,096 B2 7/2006 Holman et al.
7,075,707 B1 7/2006 Rapaport et al.
7,083,304 B2 8/2006 Rhoads
7,178,941 B2 2/2007 Roberge et al.
7,178,946 B2 2/2007 Saccomanno et al.
7,184,201 B2 2/2007 Duncan
7,246,923 B2 7/2007 Conner
7,255,469 B2 8/2007 Wheatley et al.
7,261,453 B2 8/2007 Morejon et al.
7,289,090 B2 10/2007 Morgan
7,300,177 B2 11/2007 Conner
7,303,291 B2 12/2007 Ikeda et al.
7,306,352 B2 12/2007 Sokolov et al.
7,325,956 B2 2/2008 Morejon et al.
7,342,658 B2 3/2008 Kowarz et al.
7,344,279 B2 3/2008 Mueller et al.
7,344,280 B2 3/2008 Panagotacos et al.
7,349,095 B2 3/2008 Kurosaki
7,353,859 B2 4/2008 Stevanovic et al.
7,382,091 B2 6/2008 Chen
7,382,632 B2 6/2008 Alo et al.
7,400,439 B2 7/2008 Holman
7,427,146 B2 9/2008 Conner
7,429,983 B2 9/2008 Islam
7,431,489 B2 10/2008 Yeo et al.
7,434,946 B2 10/2008 Huibers
7,438,443 B2 10/2008 Tatsuno et al.
7,476,016 B2 1/2009 Kurihara
7,520,642 B2 4/2009 Holman et al.
7,530,708 B2 5/2009 Park
7,537,347 B2 5/2009 Dewald
D593,963 S 6/2009 Plonski et al.
7,540,616 B2 6/2009 Conner
7,545,569 B2 6/2009 Cassarly
7,556,406 B2 7/2009 Petroski et al.
7,598,686 B2 10/2009 Lys et al.
7,605,971 B2 10/2009 Ishii et al.
7,626,755 B2 12/2009 Furuya et al.
7,670,021 B2 3/2010 Chou
7,677,736 B2 3/2010 Kasazumi et al.
7,684,007 B2 3/2010 Hull et al.
7,703,943 B2 4/2010 Li et al.
7,709,811 B2 5/2010 Conner
7,719,766 B2 5/2010 Grasser et al.
7,748,870 B2 7/2010 Chang et al.
7,762,315 B2 7/2010 Shen
7,766,490 B2 8/2010 Harbers et al.
7,771,085 B2 8/2010 Kim
7,819,556 B2 10/2010 Heffington et al.
7,824,075 B2 11/2010 Maxik et al.
7,828,453 B2 11/2010 Tran et al.
7,828,465 B2 11/2010 Roberge et al.
7,832,878 B2 11/2010 Brukilacchio et al.
7,834,867 B2 11/2010 Sprague et al.
7,835,056 B2 11/2010 Doucet et al.
7,845,823 B2 12/2010 Mueller et al.
7,883,241 B2 2/2011 Ho
7,889,430 B2 2/2011 El-Ghoroury et al.
7,906,722 B2 3/2011 Fork et al.
7,922,356 B2 4/2011 Maxik et al.
7,923,748 B2 4/2011 Ruffin
7,928,565 B2 4/2011 Brunschwiler et al.
7,976,205 B2 7/2011 Grotsch et al.
8,016,443 B2 9/2011 Falicoff et al.
8,021,019 B2 9/2011 Chen et al.
8,038,314 B2 10/2011 Ladewig
8,047,660 B2 11/2011 Penn et al.
8,061,857 B2 11/2011 Liu et al.
8,070,302 B2 12/2011 Hatanaka et al.
8,070,324 B2 12/2011 Kornitz et al.
8,083,364 B2 12/2011 Allen
8,096,668 B2 1/2012 Abu-Ageel
8,125,776 B2 2/2012 Alexander et al.
8,201,968 B2 6/2012 Maxik et al.
8,251,561 B2 8/2012 Montgomery et al.
8,272,763 B1 9/2012 Chinnam et al.
8,297,783 B2 10/2012 Kim
8,297,798 B1 10/2012 Pittman et al.
8,322,889 B2 12/2012 Petroski
8,328,406 B2 12/2012 Zimmermann
8,331,099 B2 12/2012 Geissler et al.
8,337,029 B2 12/2012 Li
8,337,063 B2 12/2012 Nagasawa et al.
8,419,249 B2 4/2013 Yatsuda et al.
8,427,590 B2 4/2013 Raring et al.
8,459,856 B2 6/2013 Meir et al.
8,531,126 B2 9/2013 Kaihotsu et al.
8,585,242 B2 11/2013 Walczak et al.
8,608,341 B2 12/2013 Boomgaarden et al.
8,608,348 B2 12/2013 Maxik et al.
8,616,736 B2 12/2013 Pan
8,662,672 B2 3/2014 Hikmet et al.
2002/0151941 A1 10/2002 Okawa et al.
2004/0052076 A1 3/2004 Mueller et al.
2005/0033119 A1 2/2005 Okawa et al.
2006/0002108 A1 1/2006 Ouderkirk et al.
2006/0002110 A1 1/2006 Dowling et al.
2006/0103777 A1 5/2006 Ko et al.
2006/0164005 A1 7/2006 Sun
2006/0285193 A1 12/2006 Kimura et al.
2007/0013871 A1 1/2007 Marshall et al.
2007/0041167 A1 2/2007 Nachi
2007/0188847 A1 8/2007 McDonald et al.
2007/0241340 A1 10/2007 Pan
2008/0143973 A1 6/2008 Wu
2008/0198572 A1 8/2008 Medendorp
2008/0232084 A1 9/2008 Kon
2008/0232116 A1 9/2008 Kim
2009/0059099 A1 3/2009 Linkov et al.
2009/0059585 A1 3/2009 Chen et al.
2009/0128781 A1 5/2009 Li
2009/0141506 A1 6/2009 Lan et al.
2009/0232683 A1 9/2009 Hirata et al.
2009/0310356 A1 * 12/2009 Laporte ..... F21V 5/007 362/239
2010/0006762 A1 1/2010 Yoshida et al.
2010/0039704 A1 2/2010 Hayashi et al.
2010/0084984 A1 * 4/2010 Leon Rovira ..... F21K 9/135 315/210
2010/0103389 A1 4/2010 McVea et al.
2010/0202129 A1 8/2010 Abu-Ageel
2010/0244700 A1 9/2010 Chong et al.
2010/0315320 A1 12/2010 Yoshida
2010/0321641 A1 12/2010 Van Der Lubbe
2011/0038151 A1 * 2/2011 Carraher ..... F21S 8/08 362/242

(56) References Cited

U.S. PATENT DOCUMENTS

| | | | | |
|---|---|---|---|---|
| 2011/0205738 | A1 | 8/2011 | Peifer et al. | |
| 2011/0298371 | A1* | 12/2011 | Brandes | F21K 9/135 315/32 |
| 2012/0002411 | A1 | 1/2012 | Ladewig | |
| 2012/0051041 | A1 | 3/2012 | Edmond et al. | |
| 2012/0106144 | A1 | 5/2012 | Chang | |
| 2012/0201034 | A1 | 8/2012 | Li | |
| 2012/0217861 | A1 | 8/2012 | Soni | |
| 2012/0218774 | A1 | 8/2012 | Livingston | |
| 2012/0224363 | A1* | 9/2012 | Van De Ven | F21K 9/56 362/231 |
| 2012/0236598 | A1 | 9/2012 | Germain et al. | |
| 2012/0262902 | A1 | 10/2012 | Pickard et al. | |
| 2012/0262921 | A1 | 10/2012 | Boomgaarden et al. | |
| 2012/0268894 | A1 | 10/2012 | Alexander et al. | |
| 2012/0327650 | A1 | 12/2012 | Lay et al. | |
| 2013/0021792 | A1 | 1/2013 | Snell et al. | |
| 2013/0120963 | A1 | 5/2013 | Holland et al. | |
| 2013/0223055 | A1 | 8/2013 | Holland et al. | |
| 2013/0294071 | A1 | 11/2013 | Boomgaarden et al. | |
| 2013/0294087 | A1 | 11/2013 | Holland et al. | |
| 2013/0301238 | A1 | 11/2013 | Boomgaarden et al. | |

FOREIGN PATENT DOCUMENTS

| | | |
|---|---|---|
| WO | WO2008137732 | 11/2008 |
| WO | WO2009040703 | 4/2009 |

OTHER PUBLICATIONS

U.S. Appl. No. 13/832,900, filed Mar. 2013, Holland et al.

U.S. Appl. No. 14/014,512, filed Aug. 2013, Boomgaarden et al.

U.S. Appl. No. 14/024,280, filed Sep. 2013, Boomgaarden et al.

Arthur P. Fraas, Heat Exchanger Design, 1989, p. 60, John Wiley & Sons, Inc., Canada.

EP International Search Report for Application No. 10174449.8; (Dec. 14, 2010).

H. A El-Shaikh, S. V. Garimella, "Enhancement of Air Jet Impingement Heat Transfer using Pin-Fin Heat Sinks", D IEEE Transactions on Components and Packaging Technology, Jun. 2000, vol. 23, No. 2.

J. Y. San, C. H. Huang, M. H, Shu, "Impingement cooling of a confined circular air jet", In t. J. Heat Mass Transf. , 1997. pp. 1355-1364, vol. 40.

N. T. Obot, W. J. Douglas, A S. Mujumdar, "Effect of Semi-confinement on Impingement Heat Transfer", Proc. 7th Int. Heat Transf. Conf., 1982, pp. 1355-1364. vol. 3.

S. A Solovitz, L. D. Stevanovic, R. A Beaupre, "Microchannels Take Heatsinks to the Next Level", Power Electronics Technology, Nov. 2006.

Yongmann M. Chung, Kai H. Luo, "Unsteady Heat Transfer Analysis of an Impinging Jet", Journal of Heat Transfer—Transactions of the ASME, Dec. 2002, pp. 1039-1048, vol. 124, No. 6.

* cited by examiner

SYSTEM FOR DIRECTIONAL CONTROL OF LIGHT AND ASSOCIATED METHODS

FIELD OF THE INVENTION

The present invention relates to systems and methods for controlling the direction of emitted light.

BACKGROUND OF THE INVENTION

Directional lighting from a single lighting device has traditionally been limited to the positioning of an illuminant, such as a light-emitting diode (LED) to emit light in a selected direction. As nearly all LEDs emit light in the hemisphere directly above the LED (or below depending on the configuration of the LED), the directional control of light has typically been accomplished by positioning the LED such that an apex of the LED is pointed in the direction desired to be illuminated, and the use of optics to shape the beam of light emitted by the LED. This results in the need for multiple discrete structures capable of being positioned independently of one another in order to achieve multi-directional lighting from a single device. Additionally, this requires multiple discrete circuit boards upon which the LEDs are positioned, or circuit boards that are either flexible or contain bends, both of which are cumbersome to employ. This type of device has significant costs in terms of materials for each discrete structure and for enabling repositioning thereof.

Additionally, the use of light-piping materials has enabled the redirection of light emitted by an LED such that it is emitted at a relatively distant location in a direction other than the hemisphere above the LED. However, light-piping materials typically reduce the brightness of light conducted thereby such that it is not useful for illuminating purposes. Additionally, light-piping materials are traditionally used in a single LED device, and not utilized where there is an array of LEDs.

Accordingly, there is a need in the art for a lighting device capable of enabling multi-directional lighting that is suitable for illuminating purposes, while reducing the cost of production, namely, the cost of providing structural support for the lighting device, and reducing the number of circuit boards employed for enabling said directional illumination.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to an optic for emitting light in selective directions. The optic may include a receiving section having a receiving surface, an intermediate section, and an emitting section comprising a plurality of facets. Each facet of the plurality of facets may be configured to be associated with a respective light source of a plurality of light sources. The receiving surface may be configured to direct light incident thereupon through the intermediate section to a facet of the emitting section. Each facet of the plurality of facets may be configured to redirect light received from the receiving surface. Additionally, substantially each facet of the plurality of facets may be configured to redirect light in a direction that is unique from the other facets of the plurality of facets.

In another embodiment of the invention, a lighting device for emitting light in selective directions may include a first light source structure member having an outer surface, a first plurality of light sources that may be attached to the outer surface of the light source structure member, a controller functionally coupled to the plurality of lighting devices, a power supply positioned in electrical communication with at least one of the controller and the first plurality of lighting devices, and a first optic. The first optic may include a receiving section including a receiving surface, an intermediate section, and an emitting section. The emitting section may include a plurality of facets. The first optic may be carried by the first light source structure member. Each light source of the first plurality of light sources may be positioned such that light emitted thereby is received by the receiving surface. Furthermore, the light may be directed through the intermediate section and emitted through a facet of the plurality of facets of the first optic. Each facet of the plurality of facets may be configured to redirect light in a direction that is unique from the other facets of the plurality of facets. Additionally, the controller may be configured to selectively operate each light source of the first plurality of light sources.

In some embodiments, the lighting device may further include a second light source structure member having an outer surface, a second plurality of light sources positioned on the second light source structure member, and a second optic having a receiving section including a generally planar receiving surface, an intermediate section, and an emitting section. The emitting section may comprise a plurality of facets. Furthermore, each light source of the second plurality of light sources may be positioned such that light emitted thereby is received by the receiving surface. The light may then be directed through the intermediate section and emitted through a facet of the plurality of facets of the second optic. Each facet of the plurality of facets of the second optic may be configured to redirect light in a direction that is unique from the other facets of the plurality of facets of the second optic. Additionally, the power supply may be positioned in electrical communication with at least one of the controller first plurality of light sources and the second plurality of light sources. Furthermore, the controller may be configured to selectively operate each light source of the first and second pluralities of light sources. The receiving surface of the first optic may define a first plane, and the receiving surface of the second optic may defend second plane. The first plane may be skew to the second plane. In some embodiments the first plane may be perpendicular to the second plane.

In another embodiment of the invention, there is provided a lighting device for emitting light in selective directions. The lighting device may include a plurality of lighting structures, each lighting structure of the plurality of lighting structures including a light source structure member having an outer surface and an inner surface, a plurality of light sources attached to the outer surface of the light source structure member, and an optic. The optic may comprise a receiving section including a receiving surface, an intermediate section, and an emitting section. The emitting section may include a plurality of facets. Additionally, the optic may be carried by the light source structure member adjacent to the outer surface. The lighting device may further include a controller that is functionally coupled to the plurality of light sources of each of the lighting structures of the plurality of lighting structures. Additionally, the lighting device may further include a power supply positioned in electrical communication with at least one of the controller and the plurality of light sources of the plurality of lighting structures.

The plurality of lighting structures may be positioned such that the inner surface of each light source structure member cooperates to define an internal cavity. Additionally, each of the controller and the power supply may be carried by at least one light source structure member of the plurality of lighting structures such that the controller is positioned within the internal cavity. In some embodiments, each of the controller and the power supply may be carried by a structural support of the lighting device. Similarly, each of the lighting structures of the plurality of lighting structures may similarly be carried by the structural support. Furthermore, the controller may be configured to selectively operate each light source of the plurality of light sources of each lighting structure. Each light source of the plurality of light sources of each lighting structure may be positioned such that the light emitted thereby is received by the receiving surface of the same lighting structure, directed through the intermediate section, and emitted through a facet of the plurality of facets of the optic of the same lighting structure. Additionally, each facet of the plurality of facets of each lighting structure may be configured to redirect light in a direction unique from the other facets of the plurality of facets of the same lighting structure. Furthermore, in some embodiments, each facet of the plurality of facets of each lighting structure may be configured to redirect light in a direction unique from the other facets of the plurality of facets of each lighting structure.

DETAILED DESCRIPTION OF THE PREFERRED EMBODIMENT

Figure 1:
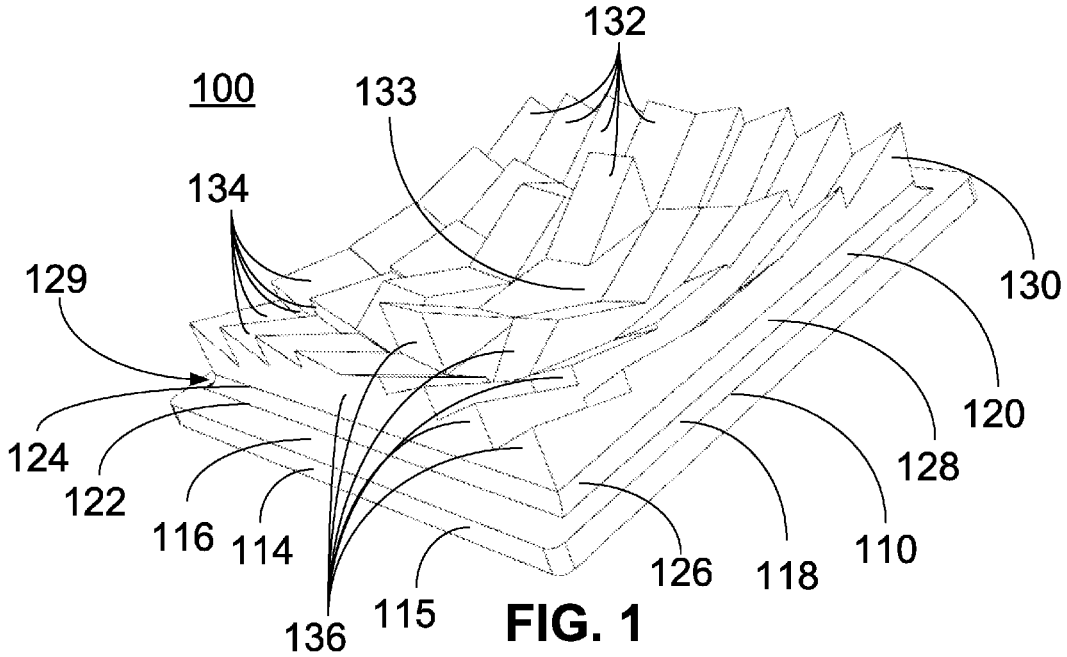
FIG. 1 is a perspective view of an optic according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Throughout this disclosure, the present invention may be referred to as relating to luminaires, digital lighting, light sources, and light-emitting diodes (LEDs). Those skilled in the art will appreciate that this terminology is only illustrative and does not affect the scope of the invention. For instance, the present invention may just as easily relate to lasers or other digital lighting technologies. Additionally, a person of skill in the art will appreciate that the use of LEDs within this disclosure is not intended to be limited to any specific form of LED, and should be read to apply to light emitting semiconductors in general. Accordingly, skilled artisans should not view the following disclosure as limited to any particular light emitting semiconductor device, and should read the following disclosure broadly with respect to the same.

An embodiment of the invention, as shown and described by the various figures and accompanying text, provides an optic for a lighting device. Referring now to FIG. 1, an optic 100 according to an embodiment of the present invention will now be discussed in detail. The optic 100 may be configured to receive light from one or more light sources and redirect that incident light in multiple directions. The direction in which the incident light is redirected may be determined by where the light is incident on the optic 100.

The optic 100 may include a receiving section 110, an intermediate section 120, and an emitting section 130. The intermediate section 120 may be positioned between the receiving section 110 and the emitting section 130. Each of the receiving section 110, the intermediate section 120, and the emitting section 130 may be formed of transparent or translucent material. Moreover, each may be formed of the same material, or a variety of materials may be used. In some embodiments, the optic 100 may be formed as a single integral structure. In other embodiments, one or more of the receiving section 110, the intermediate section 120, and the emitting section 130 may be formed apart from the other parts of the optic 100 and may be attached and placed in optical communication with the adjacent parts of the optic 100 according to any means or methods known in the art. Means and methods of attachment may include, but are not limited to, fasteners, glues, optical glues, adhesives, and the like. Additionally, optical grease may be applied between the attaching portions of the optic 100 to improve optical communication therebetween.

Figure 2:
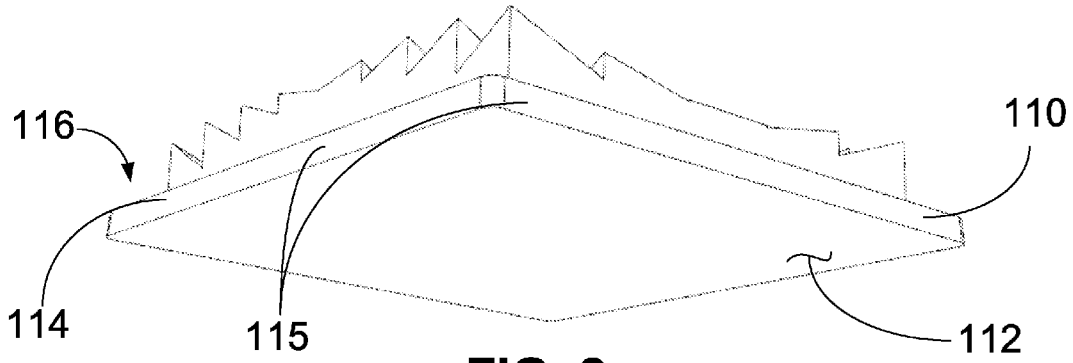
FIG. 2 is a lower perspective view of the optic of FIG. 1.

Continuing to refer to FIG. 1 and referring additionally to FIG. 2, the receiving section 110 will now be discussed in greater detail. The receiving section 110 may be configured to receive light from a light source. More specifically, the receiving section 110 may be configured to receive light from a plurality of light sources. As such, the receiving section 110 may be configured to be positioned adjacent to a plurality of light sources. In some embodiments, where the plurality of light sources are arranged in a flat, generally planar configuration, the receiving section 110 may similarly be configured to be generally planar. More specifically, the receiving section 110 may comprise a receiving surface 112, and the receiving surface 112 may be configured to be generally flat. In other embodiments, where the plurality of light sources are positioned in a generally arcuate configuration, the receiving surface 112 may be similarly configured to be generally arcuate, conforming to a curvature of the plurality of light sources. In the present embodiment, the receiving surface 112 is generally flat. Moreover, where the plurality of light sources to which the receiving section 110 is to be placed adjacent to are positioned in an array, the receiving surface 112 may be configured to have a geometric configuration that generally conforms to the configuration of the array of light sources. In the present embodiment, the receiving surface 112 has a generally rectangular configuration, forming a square with rounded corners. This geometric configuration is exemplary only, and all other configurations are contemplated and included within the scope of the invention, including, but not limited to, circles, ovals, ellipses, triangles, and any other polygon. Moreover, arcuate configurations of the receiving surface 112 are also contemplated and included within the scope of the invention. Such configurations include, but are not limited to, spherical or semi-spherical configurations, and any other ellipsoid.

The receiving surface 112 may be configured to include optical characteristics. In some embodiments, the receiving surface 112 may be polished so as to facilitate the maximum transmission of light therethrough. Additionally, the receiving surface 112 may be polished so as to have little or no refraction on light incident thereupon. Similarly, the receiving section 110 may be similarly formed so as to result in little or no refraction of light passing therethrough. More specifically, a body section 114 of the receiving section 110 may be configured so as to cause little or no refraction of light passing therethrough. Additionally, in some embodiments, each of the receiving surface 112 and the body section 114 may be configured to collimate light. More specifically, each of the receiving surface 112 and the body section 114 may be configured to collimate light in a direction orthogonal to a plane defined by the receiving surface 112. In some embodiments, as in the present embodiment, the plane may be flat. In other embodiments, the plane may be curved. Furthermore, the body section 114 may be configured to include a plurality of collimating sections. Each collimating section may be configured to collimate light incident thereupon such that light from each collimating section does not propagate into an adjacent collimating section.

Additionally, in some embodiments, the receiving surface 112 may include a material applied thereto. For example, optical grease may be applied to the receiving surface 112 so as to facilitate the transmission of light between a light source and the receiving surface 112 when the receiving section 110 is positioned adjacent to a plurality of light sources. Furthermore, as another example, a color conversion layer (not shown) may be positioned adjacent the receiving surface 112. The color conversion layer may be configured to receive light within a source wavelength range and convert the light, emitting a converted light within a converted wavelength range. The color conversion layer may be attached, deposited, or otherwise positioned on the receiving surface 112 by any means that is suitable to the material forming the color conversion layer. In some embodiments, the receiving surface 112 may include two or more color conversion layers positioned upon different sections of the receiving surface 112. Each of the two or more color conversion layers may convert respective source lights of the same or differing wavelengths to respective converted lights of differing wavelengths. The receiving surface 112 may include any number of color conversion layers, including overlapping layers. Color conversion layers may be formed of material selected from the group consisting of phosphors, quantum dots, luminescent materials, fluorescent materials, and dyes. More details regarding the enablement and use of a color conversion layer may be found in U.S. patent application Ser. No. 13/073,805, entitled MEMS Wavelength Converting Lighting Device and Associated Methods, filed Mar. 28, 2011, as well as U.S. patent application Ser. No. 13/234,604, entitled Remote Light Wavelength Conversion Device and Associated Methods, filed Sep. 16, 2011, U.S. patent application Ser. No. 13/234,371, entitled Color Conversion Occlusion and Associated Methods, filed Sep. 16, 2011, and U.S. patent application Ser. No. 13/357,283, entitled Dual Characteristic Color Conversion Enclosure and Associated Methods, the entire contents of each of which are incorporated herein by reference. Moreover, the body section 114 may be formed of a material or a mixture of materials configured to perform a similar color conversion of light passing therethrough.

The body section 114 may include one or more side surfaces 115. The number and configuration of side surfaces 115 may be defined by the geometric configuration of the receiving section 110. The side surfaces 115 may be configured to prevent light from passing therethrough. In some embodiments, the side surfaces 115 may have an absorbing or reflecting material applied thereto. Furthermore, in some embodiments, the side surfaces 115 may be configured to redirect light incident thereupon emitted by the plurality of light sources and passing through the receiving surface 112 in the direction of the interfacing surface 116. Additionally, each of the receiving surface 112 and the body member 114 may be configured to direct light so as to not be incident upon the side surfaces 115.

Additionally, the receiving section 110 may further include an interfacing surface 116. The interfacing surface 116 may be configured so as to facilitate the transmission of light from the receiving section 110 to the intermediate section 120. The interfacing section 116 may be configured to include any or all of the optical characteristics described for the receiving surface 112 and the body section 114 described hereinabove. Moreover, the interfacing section 116 may have optical grease, a color conversion layer, or other material applied to or placed adjacent thereto, in addition to or exclusive of optical grease and/or a color conversion layer associated with the receiving surface 112.

Additionally, the interfacing surface 116 may include an exposed surface 118, being defined as the section of the interfacing surface 116 that is outside the periphery of the interface between the interfacing surface 116 and the intermediate section 120. The exposed surface 118 may be configured to have the same optical characteristics as the rest of the interfacing surface 116 as described hereinabove, or it may have different characteristics. In some embodiments, the exposed surface 118 may be configured to absorb or reflect light incident thereupon, such that no light received by the receiving section 110 from the plurality of light sources passes through and is emitted by the exposed surface 118. Moreover, each of the receiving surface 112 and the body section 114 may be configured to direct light, either by directed collimation or refraction, received from the plurality of light sources away from the exposed section 118 such that little or no light may pass therethrough. In some embodiments, the exposed surface 118 may be configured to refract light incident thereupon in the direction of the interfacing surface 116 that is interfaced with the intermediate section 120. In some embodiments, the exposed surface 118 may be configured to refract light so as to emit generally diffuse light.

It is appreciated that where the optic 100 is formed as a single integral unit, or at least where the receiving section 110 and the intermediate section 120 are formed as a single integral unit, the interfacing surface 116 may be limited to the exposed surface 118.

Continuing to refer to FIG. 1, the intermediate section 120 will now be discussed in greater detail. The intermediate section 120 may be configured to facilitate the transmission of light from the receiving section 110 to the emitting section 130. Accordingly, the intermediate section 120 may be configured to receive light from the receiving section 110 and to emit light so as to be received by the emitting section 130.

Furthermore, the intermediate section 120 may include optical characteristics so as to affect light passing therethrough. In some embodiments, the intermediate section 120 may be configured to collimate light passing therethrough. More specifically, the intermediate section 120 may be configured to collimate light in a direction generally orthogonal the plane defined by the receiving surface 112. Furthermore, the intermediate section 120 may be configured to include a plurality of collimating sections. Each collimating section may be configured to collimate light incident thereupon such that light from each collimating section does not propagate into an adjacent collimating section. Moreover, in embodiments where the body section 114 of the receiving section 110 comprises a plurality of collimating sections, each collimating section of the intermediate section 120 may be associated with a collimating section of the body section 114 such that light collimated by each collimating section of the body section 114 remains collimated and continues in the established direction of travel in the associated collimating section of the intermediate section 120. Furthermore, in some embodiments, each collimating section of the intermediate section 120 may be associated with a single light source of a plurality of light sources. In some embodiments, each collimating section may be the only collimating section associated with one or more light sources of a plurality of light sources.

In some embodiments, where the intermediate section 120 is formed separate and apart from at least one of the receiving section 110 and the emitting section 130, the intermediate section 120 may be formed so as to facilitate the optical coupling thereto. For example, where the intermediate section 120 is formed separate from the receiving section 110, the intermediate section 120 may have a lower surface 122 configured to interface with and optically couple to the receiving section 110. More specifically, the lower surface 122 may be configured to interface with and optically couple to the interfacing surface 116 of the receiving section 110. Moreover, the lower surface 122 may have a coating or layer of material applied thereto or positioned thereupon. In some embodiments, a color conversion layer, as described hereinabove, may be positioned adjacent to the lower surface 122 to convert light received from the receiving section 110. Additionally, optical grease may be applied to the lower surface 122 to facilitate optical coupling between it and the interfacing surface 116.

The lower surface 122 may be configured to have a geometry that is similar to or conforms to the geometry of the interfacing surface 116. In the present embodiment, the lower surface 122 has a generally square configuration. It is appreciated that the lower surface 122 may have a geometry conforming to any polygon. Moreover, it is appreciated that the geometry of the lower surface 122 may define a surface area. In some embodiments, the surface area of the lower surface 122 may be approximately equal to a surface area of the interfacing section 116, such that the lower surface 122 is generally coextensive with the interfacing section 116. In some embodiments, the lower surface 122 may have a surface area that is less than the surface area of the interfacing surface 116. In such embodiments, the exposed surface 118 may thereby be defined as the difference in surface area resulting in a portion of the interfacing surface 116 being exposed and not covered by the lower surface 122.

Similarly, where the intermediate section 120 is formed separate from the emitting section 130, the intermediate section 120 may include an upper surface 124 configured to optically couple to the emitting section 130. The upper surface 124 may have any of the characteristics and additional features, including color conversion layers and optical grease, as the lower surface 122.

It is appreciated that in embodiments where the intermediate section 120 is integrally formed with either of the receiving section 110 and the emitting section 130, the lower and upper surfaces 122, 124, respectively, may be absent in such embodiments.

The intermediate section 120 may further include a body section 126. The body section 126 may be configured to facilitate the traversal of light therethrough, from the lower surface 122 to the upper surface 124. Moreover, the body section 126 may be configured to have optical characteristics to affect light passing therethrough. Any of the characteristics as described for the body section 114 of the receiving section 110 may be included in the body section 126 of the intermediate section 120.

Furthermore, the body section 126 may have one or more sidewalls 128. The sidewalls 128 may be configured to have a curvature 129. The curvature 129 may be necessitated by a difference in the surface areas of the lower surface 122 and the upper surface 124. The sidewalls 128 may be configured to redirect light incident thereupon, as a result of the differences in the surface areas of the lower and upper surfaces 122, 124, in the direction of the upper surface 124.

Continuing to refer to FIGS. 1 and 2, the emitting section 130 will now be discussed in greater detail. The emitting section 130 may be configured to receive light from the intermediate section 120 and to emit the received light. More specifically, the emitting section 130 may be configured to emit light in such a manner so as to enable the control of the direction of light emitted from the optic 100.

The emitting section 130 may include a plurality of facets 132. Each facet 132 may be configured to emit light. More specifically, each facet 132 may be configured to emit light in a particular direction. In some embodiments, each facet 132 of the plurality of facets 132 may be configured to emit light in a direction that is unique from the direction of light emitted by the other facets 132 of the plurality of facets 132.

The plurality of facets 132 may be configured so as to enable a user to selectively emit light from a plurality of light sources, the emitted light being received by the receiving surface 112, passing through each of the receiving section 110 and the intermediate section 120, and being emitted by the emitting section 130 through one or more of the plurality of facets 132 in a direction selected by the user. In some embodiments, when a user operates a single light source of the plurality of light sources, light may be emitted by a single facet 132 of the plurality of facets 132 in a single direction, such that the optic 100 emits light only from that facet 132, and hence only in that direction. Accordingly, in some embodiments, each facet 132 may be associated with a single light source of a plurality of light sources. Moreover, in some embodiments, each facet 132 of the plurality of facets 132 may be the only facet associated with the light source. In some other embodiments, two or more facets 132 of the plurality of facets 132 may be associated with a single light source. In some embodiments, two or more light sources may be associated with a single facet 132. Where a single facet 132 is configured to be associated with two or more light sources, light emitted by the two or more light sources may combine to form a combined light. In some embodiments, the combined light may be a white light. It is contemplated and included within the scope of the invention that any combination of light, or specifically, light having differing wavelengths ranges corresponding to differing colors, may combine to form a combined light that is a member, a light that is perceived as a combination of the two colors.

Each facet may have a projected surface area that corresponds and generally conforms to a section of the upper surface 124 of the intermediate section 120. In some embodiments, where the intermediate section 120 comprises a plurality of collimating section, each facet 132 may have associated with it one or more collimating sections. In such embodiments, each facet 132 may be associated with the light source(s) with which the associated collimating section of the intermediate section 120 is associated.

Each facet 132 of the plurality of facets 132 may include an emitting surface 134 and one or more redirecting surfaces 136. The redirecting surfaces 136 may be configured to redirect light in the direction of the emitting surface 134. Accordingly, substantially all of the light emitted by the facet 132 may be emitted through the emitting surface 134. The emitting surface 134 may be configured so as to emit light in a selected direction. Moreover, the emitting surface 134 may be configured to emit light having a selected divergence. In some embodiments, the emitting surface 134 may be configured so that the divergence of light emitted therefrom is relatively low, such that a spot light is emitted by the facet 132. Accordingly, the optic 100 may be configured to emit light as a combination of a plurality of spot lights, each spot light being light emitted through each facet 132 of the plurality of facets 132.

Figure 3:
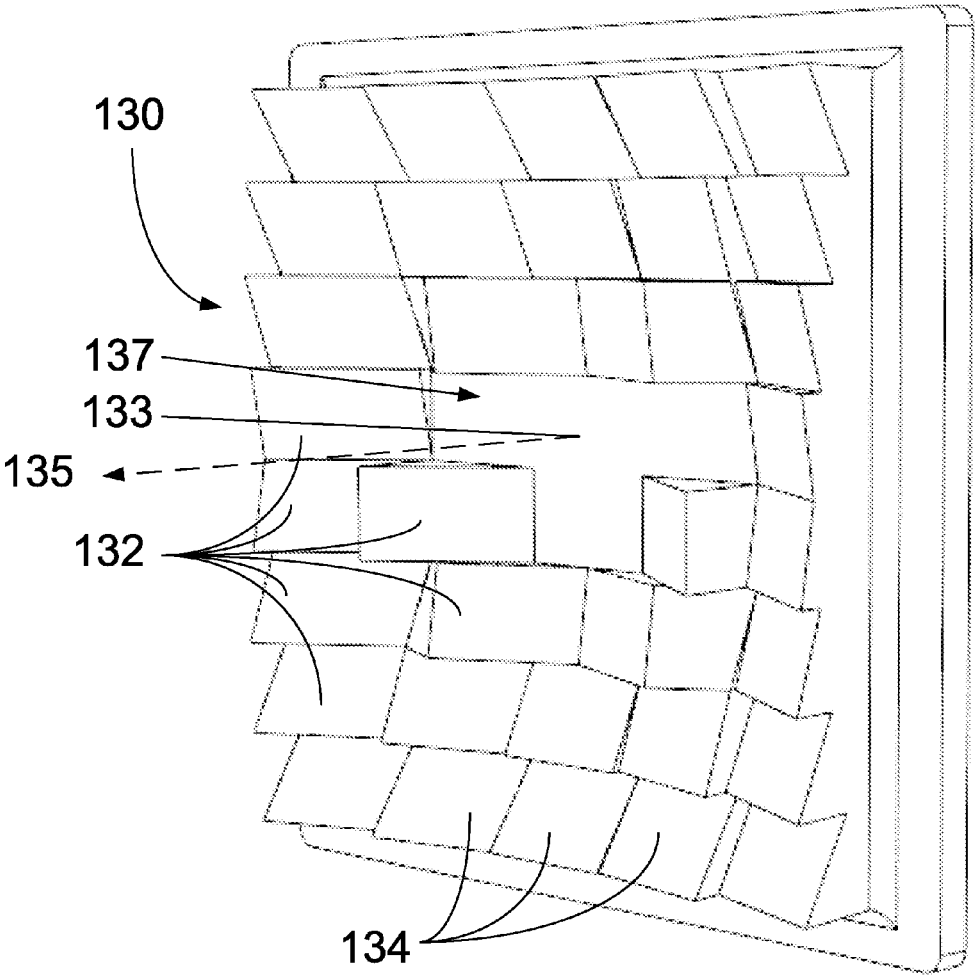
FIG. 3 is another perspective view of the optic of FIG. 1.

Referring now additionally to FIG. 3, additional aspects of the emitting section 130 will now be discussed in greater detail. In some embodiments, the emitting section 130 may be configured such that a portion 137 of the emitting section 130 is generally flat and surrounded by the plurality of facets 132. Moreover, the generally flat portion 137 may be positioned such that the center 133 is located therein.

The emitting surface 134 of each facet 132 may be configured to emit light in a selected direction. More specifically, the emitting surface 134 of each facet 132 may be configured to emit light in a direction that is generally orthogonal to a plane defined by the emitting surface 134. Accordingly, the direction in which light is emitted from each emitting surface 134 may be individual to each facet 132, as the plane defined by the emitting surface 134 of each facet 132 may be skew to every other plane defined by the emitting surface 134 of every other facet 132 of the plurality of facets 132. Moreover, the direction in which each facet 132 emits light may be measured in a polar system, whereby a line that is normal to the plane defined by the emitting surface 134 of each facet 132 may be measured in terms of first and second angles corresponding to a polar system. In some embodiments, each facet 132 may be configured to emit light in a direction such that at least one of the first and second angles formed by the line normal to the plane defined by the emitting surface 134 of the facet 132 is non-equal to the first or second angle, respectively, every other line normal to the plane defined by the emitting surface 134 of the other facets 132 of the plurality of facets 132. In some embodiments, a facet 132 may be configured to emit light in a direction such that at least one of the first and second angles formed by the line normal to the emitting section 134 of the facet 132 is equal to the first and/or second angle, respectively, of a line normal to the emitting section 134 of at least one other facet 132 of the plurality of facets 132.

The direction in which each facet 132 is configured to emit light may be selected based on any desired distribution of light, either individually to each facet 132 or in various combinations of facets 132 of the plurality of facets 132. Moreover, the direction in which each facet 132 is configured to emit light may be selected based on a pattern or methodology. In the present embodiment, the plurality of facets 132 may be configured to emit light in a direction that is a function of the location of the facet 132 within the emitting section 130. More specifically, the plurality of facets 132 may be configured to emit light in the direction it is a function of the location of the facet 132 relative to the center 133 of the emitting section 130. In the present embodiment, each facet 132 may be configured to emit light generally in the direction of a line 135 that is normal to the generally flat portion 137 of the emitting section 130 and passing through the center 133. In some other embodiments, each facet 132 may be configured to emit light generally in a direction away from the line 135. This methodology of configuring the plurality of facets 132 is exemplary only, and any other pattern or methodology of configuring the plurality of facets 132 is contemplated and included within the scope of the invention.

In some embodiments, the plurality of facets 132 may include a color conversion layer. The color conversion layer may be formed of any material script hereinabove. In some embodiments, the color conversion layer may be positioned adjacent to the emitting surface 134 of each facet 132. In some embodiments, a color conversion material may be integrally formed with each facet 132. A first color conversion material may be associated with the first facet 132, and the second color conversion material may be associated with a second facet 132. The first color conversion material may be configured to emit a converted light within a first wavelength range corresponding to a first color, and the second color conversion material may be configured to emit a converted light within a second wavelength range corresponding to a second color. Moreover, in some embodiments, more than one color conversion material may be present and associated with a single facet 132 such that a portion of the light emitted by the facet 132 may be within a first wavelength range, and another portion of the light emitted by the facet 132 may be within a second wavelength range. Furthermore, where a facet 132 includes a color conversion layer configured to convert a source light within a source wavelength range and emit a converted light within a converted wavelength range, only a portion of the light that is emitted by the facet 132 may be converted, such that the light emitted by the facet 132 is a combination of light within the source wavelength range and light within the converted wavelength range.

Figure 4:
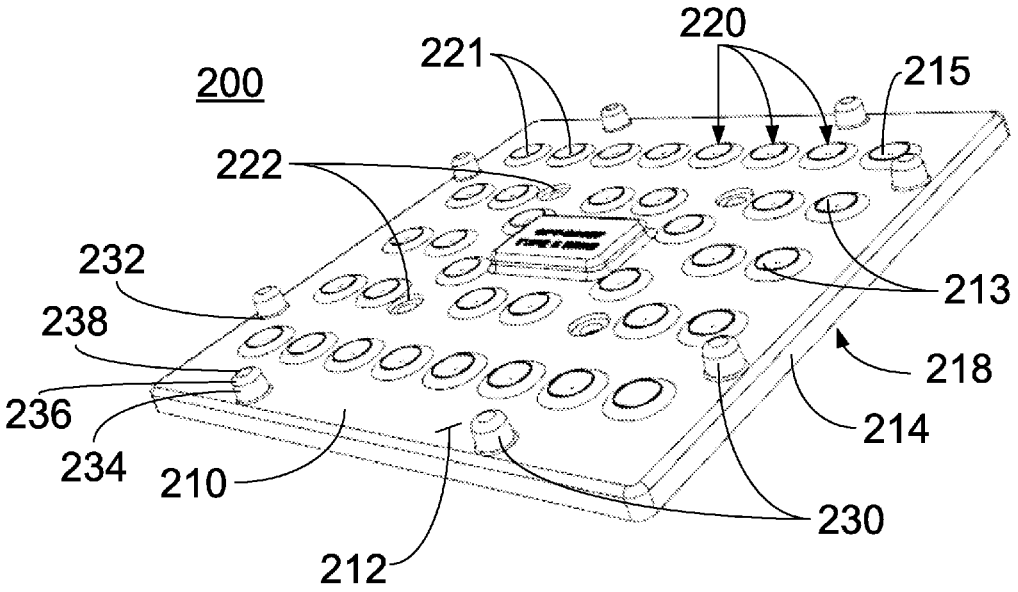
FIG. 4 is a perspective view of a light source structure member to be used in connection with a lighting device according to an embodiment of the present invention.
Figure 5:
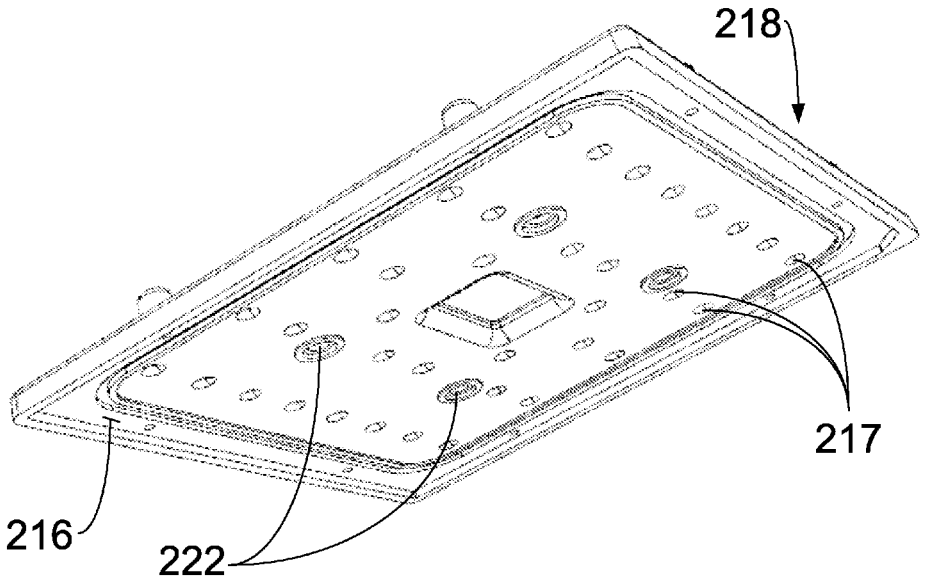
FIG. 5 is a lower perspective view of the light source structure member of FIG. 4.

Referring now to FIGS. 4-5, additional aspects of the present invention will now be discussed. More specifically, a light source structure member 200 configured to cooperate with the optic 100 of FIGS. 1-3 is presented. The light source structure member 200 may include a base member 210, a plurality of light sources 220 positioned upon the base member 210, and a plurality of optic attachment members 230.

The base member 210 may be configured to permit the plurality of light sources 220 to be positioned thereupon so as to emit light that is incident upon the optic 100. More specifically, the base member 210 may be configured to permit the plurality of light sources 220 to be positioned thereupon so as to emit light that is incident upon the receiving section 110. More specifically, the base member 210 may be configured to permit the plurality of light sources 220 to be positioned thereupon so as to emit light is incident upon the receiving section 110 such a manner so as to control the direction of light that is emitted by the optic 100.

The plurality of light sources 220 may include a plurality of devices operable to emit light. Any type of device operable to emit light known in the art are contemplated included within the scope of the invention, including, but not limited to, light-emitting semiconductors, such as light-emitting diodes (LEDs), incandescent bulbs, florescent bulbs, including compact fluorescent lights (CFLs), arc lights, halogen, and the like. In the present embodiment, the plurality of light sources 220 may include a plurality of LEDs 221. The plurality of LEDs 221 may include any type of LED known in the art. Moreover, the LEDs 221 included in the plurality of LEDs 221 may be selected based on the characteristics of light emitted thereby the characteristics of light that may be considered includes but is not limited to brightness, wavelength range, color, color temperature, luminous efficiency, luminous efficacy, and the like. Each LED 221 of the plurality of LEDs 221 may have the same characteristics of light, or any of the characteristics may vary LED to LED. Moreover, each LED 221 of the plurality of LEDs 221 may be selected so as to emit light selected lighting characteristics when emitted by the optic 100. For example, where an element of the optic 100 includes color conversion material, an LED 221 configured to emit light within a wavelength range corresponding to a source wavelength range for the color conversion material such that light emitted by the LED 221 is incident upon the color conversion material and the color conversion material may emit a converted light within a converted wavelength range.

The base member 210 may include an upper surface 212, one or more side surfaces 214, a lower surface 216, and a thickness 218 between the upper surface 212 and the lower surface 216. Each of the upper surface 212, the lower surface 216, and the thickness 218 may be configured to permit the positioning of the plurality of light sources 220 thereupon. Additionally, in some embodiments, each of the upper service 212 and the lower surface 216 may be configured to permit the plurality of light sources 220 to be positioned in optical communication with the optic 100. The nature of the light source 220, for example, its structural characteristics and light emission distribution characteristics may alter the nature of the configuration of each of the upper surface 212 and the lower surface 200.

In the present embodiment, where the plurality of light sources 220 includes a plurality of LEDs 221, the base member 210 may be configured to permit each LED 221 of the plurality of LEDs 221 to be positioned in optical communication with the optic 100. More specifically each of the upper surface 212, the lower surface 216, and the thickness 218 may be configured to permit each LED 221 of the plurality of LEDs 221 to be positioned in optical communication with the optic 100. In the present embodiment, the lower surface 216 may include a plurality of cavities 217. Each cavity 217 may extend into the thickness 218 and may be configured to permit an LED 221 to be positioned at least partially there within. More specifically, each cavity 217 may be configured to permit a light-emitting portion of an LED 221 to be positioned therein.

Additionally, the upper surface 212 may include a plurality of features 213 configured to facilitate the optical communication between the plurality of LEDs 221 and the optic 100. The arrangement of the plurality of features 213 on the upper surface 212 may correspond to the arrangement of the plurality cavities 217 on the lower surface 216. More specifically, the plurality of cavities 217 may extend through the thickness 218 such that light emitted by an LED 221 positioned within each individual cavity 217 may be incident upon an associated feature 213. Accordingly, each cavity 217 of the plurality of cavities 217 may be associated with a feature 213 of the plurality of features 213.

The distribution of the cavities 217 and the features 213 may be configured to correspond with the distribution of the facets 132 of the optic 100. In some embodiments, each pair of a cavity 217 and a feature 213 may be associated with a facet 132 of the plurality of facets 132. In some embodiments, more than one pair of a cavity 217 and a feature 213 may be associated with a single facet 132. In some embodiments a single pair of a cavity 217 and a feature 213 may be associated with more than one facet 132.

The plurality of features 213 may be configured to facilitate the optical communication between the plurality of LEDs 221 and the optic 100. In some embodiments, the plurality of features 213 may have a generally sloped profile. Additionally, in some embodiments, the plurality of features 213 may include an optical component 215. The optical component 215 may be formed of a transparent or translucent material. Additionally, the optical component 215 may be configured to interact with light incident thereupon and passing there through so as to alter the characteristics of the instant light. For example, in some embodiments, the optical component 215 may be configured to reflect, refract, collimate, or otherwise redirect light incident thereupon. Additionally, in some embodiments, the optical component 215 say be configured to diffuse light incident thereupon.

Light that is emitted from each LED 221 of the plurality of LEDs 221 and emitted from the feature 213 associated with each LED 221 may be incident upon the receiving surface 112 of the optic 100. More specifically, light emitted from each feature 213 may be incident upon the receiving surface 112 and pass therethrough, and may similarly be incident upon the intermediate section 120 and past therethrough, and may finally be incident upon the emitting section 130. More specifically, light emitted from each feature 213 may be incident upon a facet 132 of the emitting section 130 and may be emitted by the facet 132. Hence, light emitted by a feature 213 may result in the facet 132 associated with the feature 213 emitting light. As light is emitted from each feature 213, it may be reflected, refracted, collimated, or otherwise redirected so as to be emitted by the facet 132 that is associated with the feature 213. Such redirection may be accomplished by the inclusion of features configured to accomplish such redirection in any of the various elements of the light source structure member 200 and the optic 100 as disclosed hereinabove. Accordingly, when light is emitted from a feature 213, light may be emitted from the optic 100 by the facet 132 in a direction that is normal to a plane defined by an emitting surface 134 of the facet 132. As each feature 213 is associated with an LED 221 of the plurality of LEDs 221, when a single LED 221 is operated, the light emitted from the operated LED 221 may be emitted, in some embodiments, by a single facet 132 in a direction that is normal to a plane defined by the emitting surface 134 of the facet 132. Accordingly, the direction in which light is emitted from the optic 100 may be controlled by the selective operation of the LEDs 221 of the plurality of LEDs 221.

The base member 210 may be configured to have a geometric shape. Some embodiments, the base member 210 may be configured to have substantially the same shape as the optic 100. More specifically, the base member 210 may be configured to have substantially the same geometric shape as the receiving section 110 of the optic 100. In the present embodiment, the base member 210 may have a generally square shape. The base number 210 may be configured to have a shape conforming to any polygon.

The base member 210 may further include a plurality of attachment ports 222. The plurality of attachment ports 222 may facilitate the attachment of the base member 210 to a structure. In some embodiments, the plurality of attachment ports 222 may permit the base member 210 to be attached to a support structure. Such an embodiment will be discussed in greater detail hereinbelow. In some embodiments, the plurality of attachment ports 222 may facilitate the attachment of the base member 210 to a structural surface, such as a wall, ceiling, or floor. The plurality of attachment ports 222 may be configured to permit the positioning of a fastener therethrough. Accordingly, in some embodiments, the plurality of attachment ports 222 may be formed as an aperture through the thickness 218 of the body member 210, such that a fastener may pass from the upper surface 212 to the lower surface 216 and beyond. Additionally, in some embodiments, the aperture may be countersunk. This method of attachment is exemplary only, and any and all other means or methods of attachment known in the art are contemplated and included within the scope of the invention.

Continuing to refer to FIG. 4, the optic attachment members 230 will now be discussed in greater detail. The optic attachment members 230 may be configured to facilitate the positioning of an optic 100 adjacent to the upper surface 212. More specifically, the optic attachment members 230 may be configured to facilitate the positioning of an optic 100 adjacent to, and in optical communication with, the plurality of features 213 of the upper surface 212. Additionally, the optic attachment members 230 may be configured to retain and carries the optic 100 and a selected position relative to the light source structure member 200, preventing the movement of the optic 100 relative to the light source structure member 200. Each optic attachment member 230 may be configured as an outcropping extending generally away from the upper surface 212. In some embodiments, the optic attachment members 230 may extend in a direction generally orthogonal to the upper surface 212.

Each optic attachment member 230 may include a base section 232, an extension section 234, a rounded section 236, and an upper section 238. The base section 232 may be generally adjacent to the upper surface 212. In some embodiments, the base section 232 may be configured to facilitate the attachment of the optic attachment member 230 to the upper surface 212. Any method or means of attachment as is known in the art may be used, including, but not limited to, adhesives, glues, welding, fasteners, and the like. It is contemplated included within the scope of the invention that, in some embodiments, the optic attachment members 230 may be integrally formed with the base member 210. The extension section 234 may extend generally away from the base section 232 in a direction generally away from the upper surface 212. In some embodiments, the extension section 234 may be sloped, more specifically, maybe sloped generally inward from a perimeter defined by the base section 232. The perimeter defined by the base section 232 may generally define the shape of the extension section 234. In the present embodiment, the base section 232 is generally circular in shape, thereby defining a circular perimeter. As such, the extension section 234 is generally cylindrical in shape. However, where the extension section 234 is sloped, the extension section 234 may be generally conical in shape. More specifically, the extension section 234 may be generally frustoconical in shape.

The rounded section 236 may be positioned adjacent to an end of the extension section 234 generally opposite the base section 232. The rounded section 236 may be rounded inward in the direction of the upper section 238. The upper section 238 may define an upper end the optic attachment member 230. Moreover, in some embodiments, the upper section 238 may be generally flat.

The optic attachment members 230 may be configured attached to the optic 100 so as to position the optic 100 as described hereinabove. In some embodiments, the optic attachment members 230 may be configured to attach removably the optic 100. Any means or method of attachment as is known in the art may be employed, moving, but not limited to, adhesives, glues, interference fits, frictional fits, welding, fasteners, and the like.

In the present embodiment, the optic attachment members 230 may be configured to extend into a section of the optic 100 that is configured to receive the optic attachment members 230. More specifically, the material of each optic attachment member 230 may facilitate the attachment of the optic 100 to the optic attachment members 230. For example, the optic attachment members 230 may be formed of a material having a generally increased coefficient of friction. Moreover, the optic attachment members 230 may be formed of a material that is generally compressible. Accordingly, where the optic attachment members 230 are positioned within a section of the optic 100 configured to receive the optic attachment members 230, the optic 100 may generally compress the optic attachment members 230 and, more specifically, may compress at least one of the extension section 234 and the rounded section 236, increasing the friction therebetween and attaching thereby. This method of attaching the optic 100 to the optic attachment members 230 is exemplary only and does not limit the scope of methods of attachment. An optic 100 that has been attached to the light source structure member 200 is illustrated, for example, in FIG. 6.

Figure 7:
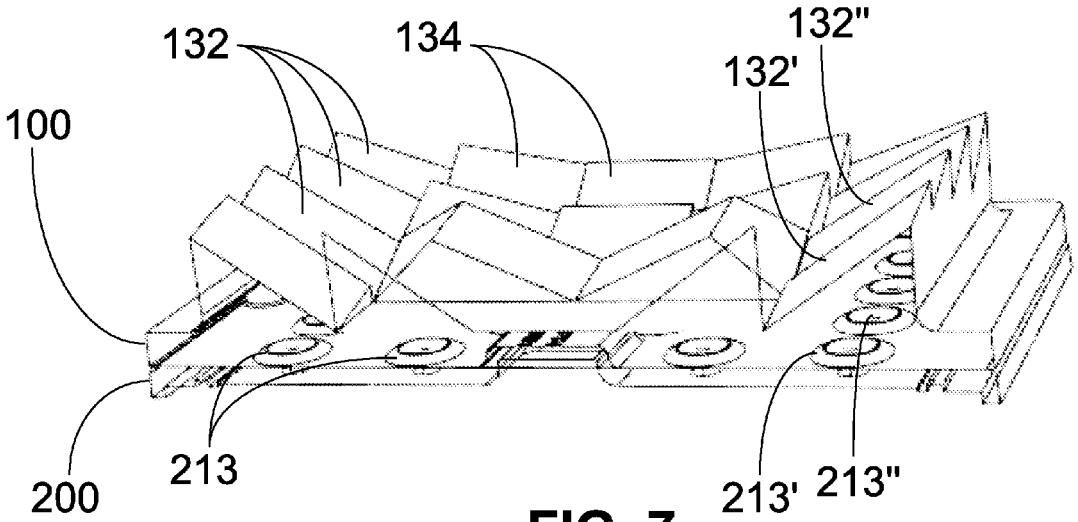
FIG. 7 is a perspective sectional view of the light source structure member and optic of FIG. 6 taken through line 7-7.

Referring now to FIG. 7, additional aspects of the attachment between the optic 100 and the light source structure member 200 will now be discussed in greater detail. As disclosed hereinabove, the optic 100 may be positioned adjacent to the light source structure member 200 such that each feature 213 is positioned in optical communication with an associated facet 132. For example, in the present embodiment, a first feature 213' may be positioned in optical communication with a first facet 132'. Additionally, a second feature 213" may be positioned in optical communication with a second facet 132". The positioning of each of the first and second features 213', 213" in optical communication with each of the first and second facets 132', 132" will depend on the optical characteristics of all of the elements, as well as the optical characteristics generally of the light source structure member 200 and the optic 100. In the present embodiment, each of the first and second features 213', 213" may be positioned so as to be generally vertically aligned with each associated feature 132', 132", respectively. Accordingly, light may be emitted by each of the first and second features 213', 213", propagate generally upwards, and be emitted by the emitting surface 134 of each of the first and second facets 132', 132". Similar positioning may be adopted for the remaining facets 132 of the plurality of facets 132 and features 213 of the plurality of features 213.

Figure 6:
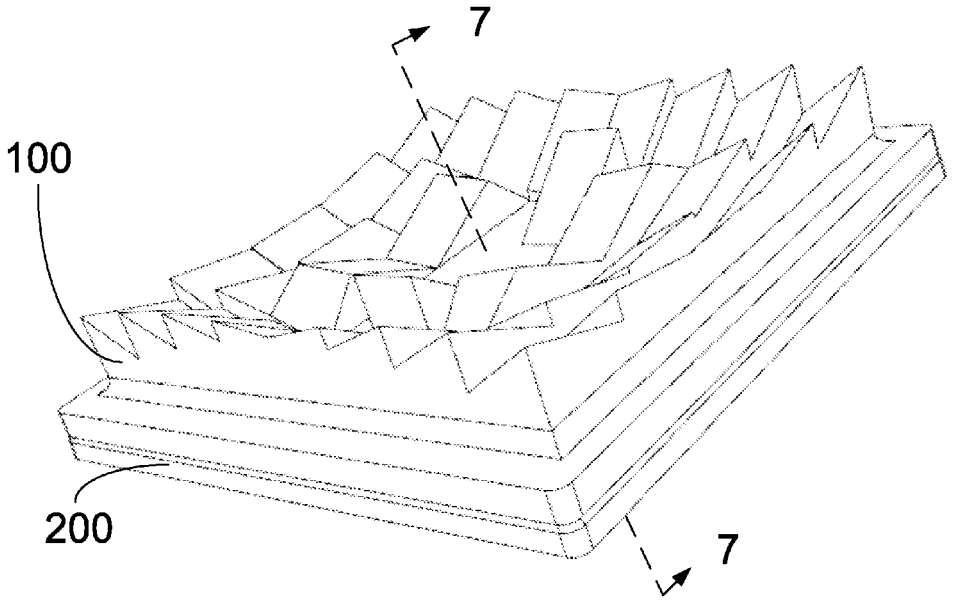
FIG. 6 is a perspective view of the light source structure member of FIG. 4 with the optic of FIG. 1 positioned adjacent thereto.
Figure 8:
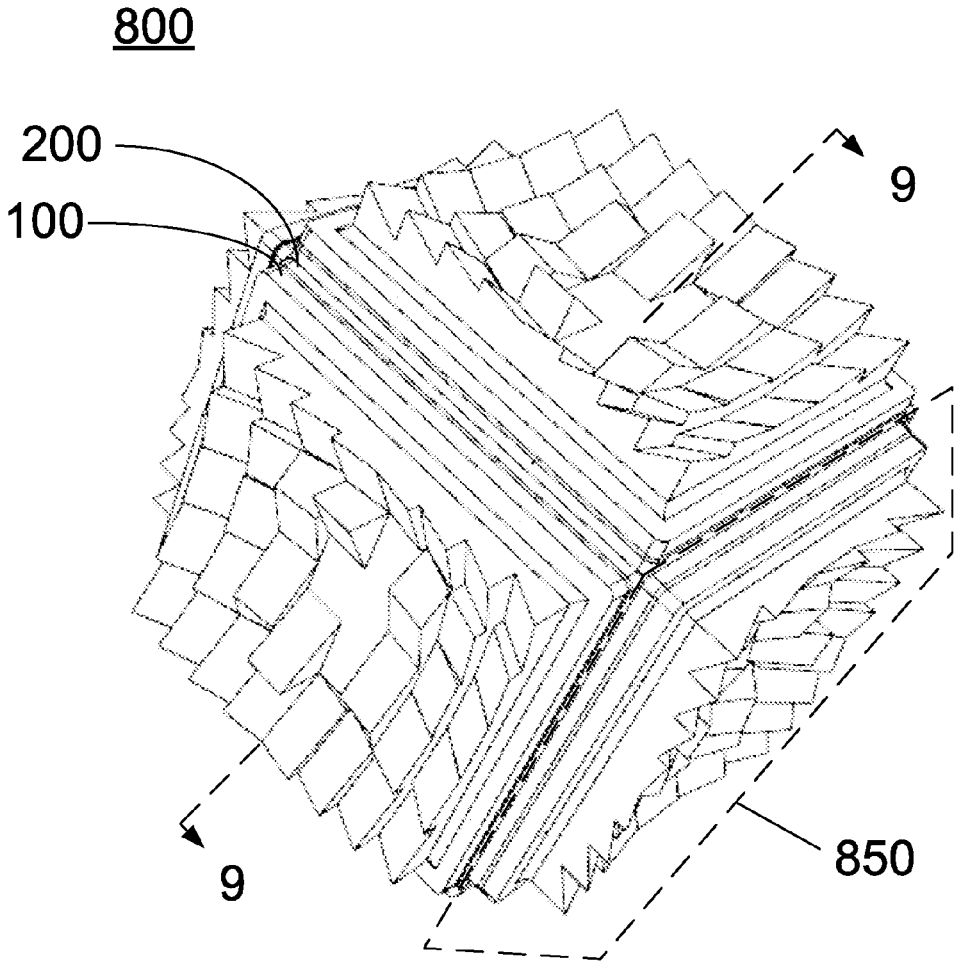
FIG. 8 is a perspective view of a lighting device according to an embodiment of the present invention.

Referring now to FIG. 8, an additional embodiment of the invention will now be discussed in greater detail. In FIGS. 6-7, a single pair (or combination) of an optic 100 and a light source structure member 200 was discussed. In some embodiments of the invention, more than one combination of an optic 100 and a light source structure member 200 may be included in a single lighting device, each combination being referred to as a lighting structure. As shown in FIG. 8, many of such lighting structures are depicted as being included in a lighting device 800. The lighting device 800 may include a plurality of lighting structures 850. Each lighting structure 850 of the plurality of lighting structures 850 may be a combination of an optic 100 and a light source structure member 200 as described hereinabove. Each lighting structure 850 may be positioned so as to be adjacent to at least one other lighting structure 850 of the plurality of lighting structures 850. For example, in some embodiments, two lighting structures 850 may be provided. The lighting structures 850 may be positioned such that a first plane defined by the lower surface 216 of one of the lighting structures 850 is skew to a second plane defined by the lower surface 216 of the other lighting structure 850. Furthermore, in some embodiments, the first plane may be perpendicular to the second plane.

Additionally, in some embodiments, the plurality of lighting structures 850 may be positioned so as to define a geometric shape of the lighting device 800. In the present embodiment, the plurality of lighting structures 850 is positioned so as to define a generally cubic shape. It is contemplated, however, and intended to be included within the scope of the invention, that any other geometric configuration resulting from the positioning of the plurality of lighting devices 850 defining a shape may be arranged, including, but not limited to, pyramids, boxes, or any other polyhedron, including regular polyhedral shapes. In some embodiments, a complete polyhedron may not be defined, wherein at least one face of the polyhedron is left unoccupied by a lighting structure 850. Such embodiments may be advantageous where the lighting device 800 is to be attached to a surface of an external structure.

Additionally, the geometric configuration of the lighting device 800 may depend upon the shape of each lighting structure 850. In the present embodiment, where each lighting structure 850 has a generally square shape, the plurality of lighting structures 850 may readily be arranged to form a lighting device 800 having a generally cubic shape. In some embodiments, the plurality of lighting structures 850 may have a geometric configuration other than a square, and, accordingly the lighting device 800 may have a geometric configuration of the shape other than acute. Additionally, in some embodiments, the shape of one lighting structure 850 is different from the shape of another lighting structure 850, the geometric configuration of the lighting device 800 may be determined as a result of the variation in shapes between the various lighting structures 850.

In some embodiments, as in the present embodiment, the plurality of lighting structures 850 may be positioned so as to be immediately adjacent to one another. In some embodiments, the lighting device 800 may include a support structure (not shown). The support structure may be configured to position the plurality of lighting structures 850 into a selected arrangement. For example, in the present embodiment, the support structure may be configured to position the plurality of lighting structures 850 into a generally cubic shape. Each lighting structure 850 may be attached to the support structure any means or method known in the art. For example, the support structure may be configured to cooperate with the attachment ports 222 of the light source structure member 200. More specifically, the support structure may be configured to permit the attachment of a fastener thereto, wherein the fastener is positioned so as to pass through an aperture of the attachment ports 222, as shown in FIGS. 4-5, thereby attaching the light source structure member 200 to the support structure. Each lighting structure 850 may be similarly attached to the support structure in this manner.

Figure 9:
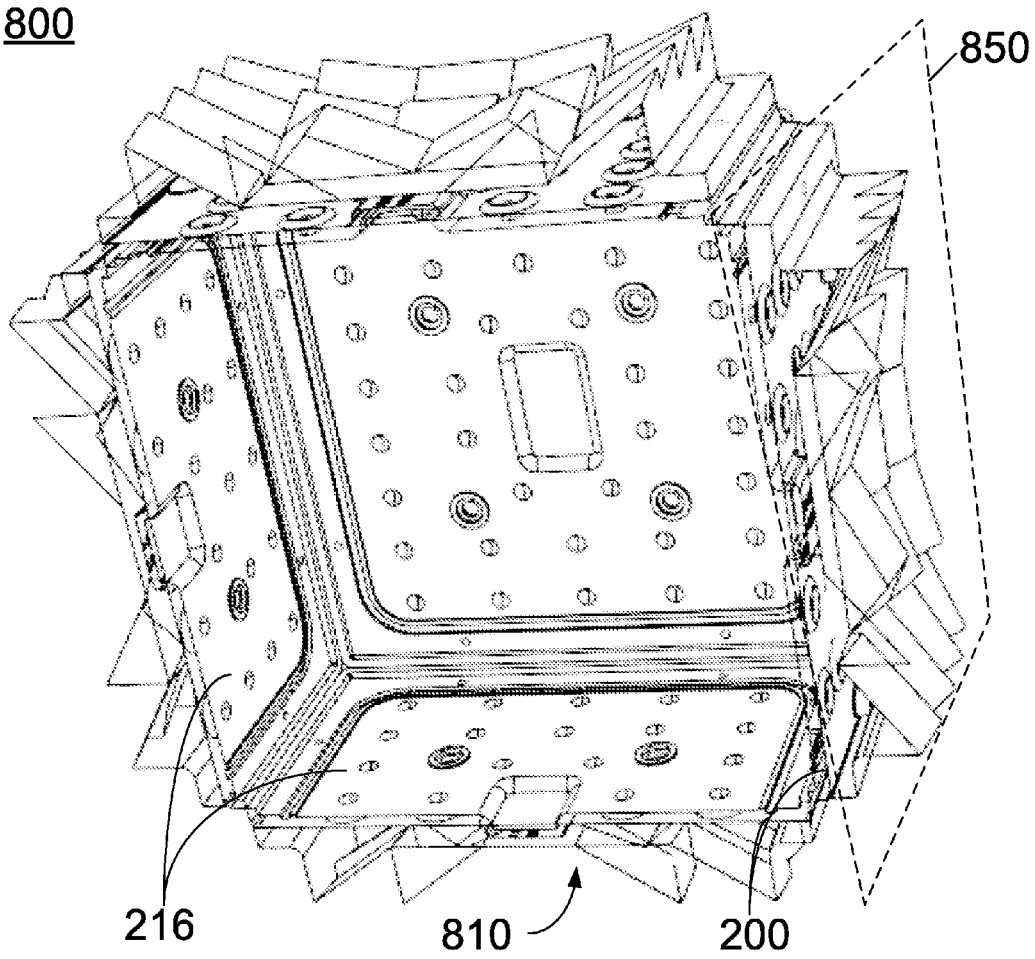
FIG. 9 is a perspective sectional view of the lighting device of FIG. 8 taken through line 9-9.

Referring now to FIG. 9, additional aspects of the lighting device 800 will now be discussed in greater detail. The plurality of lighting structures 850 may be positioned so as to define internal cavity 810. Each of the lower surfaces 216 of the light source structure members 200 of the plurality of lighting structures 850 may define a boundary of the internal cavity 810. Various electrical components utilized in the operation of each lighting structure 850 of the plurality of lighting structures 850 may be positioned within the internal cavity 810. In some embodiments, the electrical components utilized in the operation of the plurality of lighting structures 850 may be attached to and carried by support structure.

Figure 10:
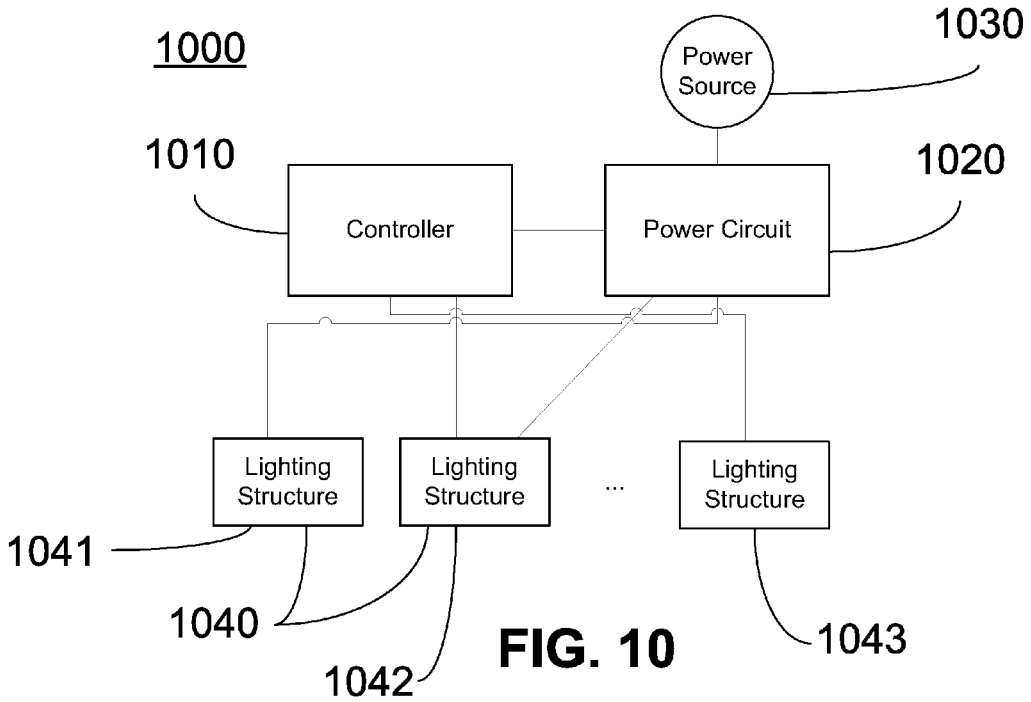
FIG. 10 is a schematic representation of a lighting device according to an embodiment of the present invention.

Referring now to FIG. 10, a schematic representation of an embodiment of the electrical components of a lighting device 1000 according to an embodiment of the invention will now be discussed in greater detail. As recited hereinabove, the lighting device 1000 may include electrical components to enable and control the operation of the plurality of lighting structures 1040. Examples of such electrical components may include a controller 1010 and a power circuit 1020. The power circuit 1020 may be configured to be positioned in electrical communication with an external power source 1030, and may be configured to condition, rectify, and otherwise alter electricity received from the power source 1030 so as to be used by the various electrical components of the lighting device 1000, including the controller 1010 and the plurality of lighting structures 1040. Accordingly, the power circuit 1020 may be positioned in electrical communication with the controller 1010 and each lighting structure of the plurality of lighting structures 1040. In some embodiments, the controller 1010 and the power circuit 1020 may be contained on a single circuit board, and may be considered a single integral electronic component.

The controller 1010 may be positioned in electrical communication with each lighting structure 1040 of the plurality of lighting structures 1040 and may be configured to control the operation of each lighting structure 1040 of the plurality of lighting structures 1040. For example, the controller 1010 may be positioned in electrical communication with each of a first lighting structure 1041, a second lighting structure 1042, and an nth lighting structure 1043. More specifically, the controller 1010 may be configured to control the operation of the plurality of LEDs 221 of each of the plurality of lighting structures 850. For example, referring now back to FIGS. 4-7, the controller 1010 may be configured to operate a single LED 221 of the plurality of LEDs 221, thereby causing the first feature 213' of the plurality of features 213, which is associated the single LED 221 the controller 1010 selectively operates, thereby causing the first facet 132' to emit light. The controller 1010 may be configured to selectively operate each individual LED 221 of the plurality of LEDs 221, thereby enabling the controller 1010 to selectively emit light from each facet 132 of the plurality of facets 132. Accordingly, the controller 1010 may be configured to control the direction in which light is emitted from the lighting device 800 by selectively operating at least one LED 221 of the plurality of LEDs 221 of at least one of the plurality of lighting structures 1040 of the lighting device 800. The direction in which light is emitted from the lighting device 800 and the result of the lighting structure 1040 that the LED 221 operated by the controller 1010 is contained within, and configuration of the facet 132 associated with the LED 221 operated by the controller 1010, namely, the direction in which the emitting surface 134 of the facet 132 is configured to emit light.

Figure 11:
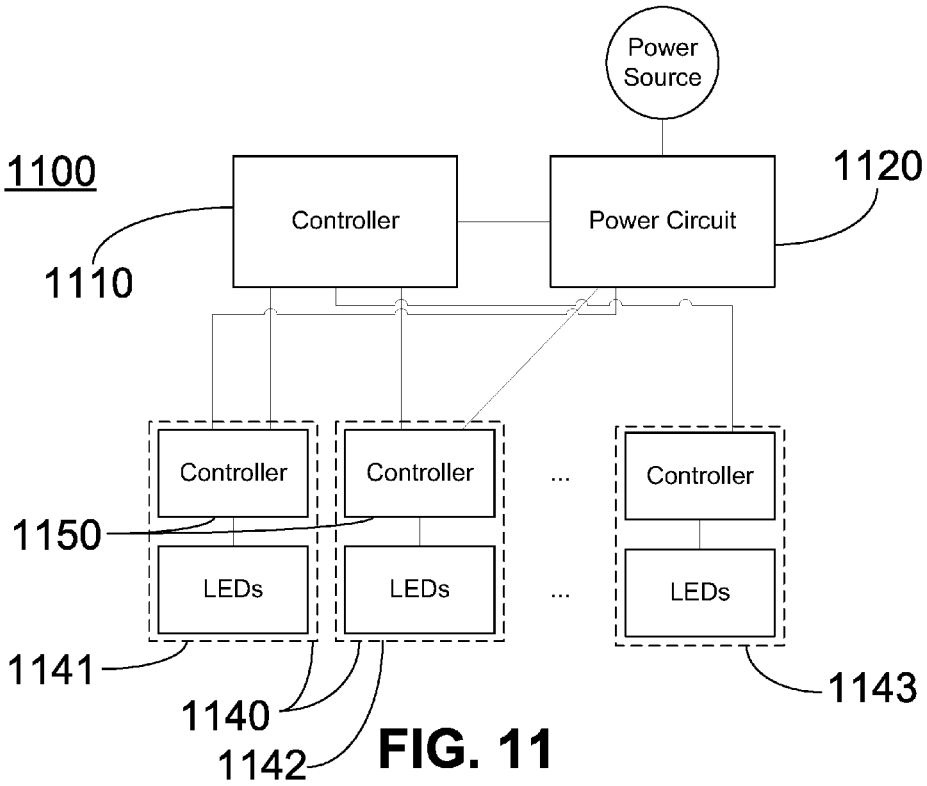
FIG. 11 is a schematic representation of a lighting device according to another embodiment of the present invention.

Referring now to FIG. 11, a schematic representation of an alternative embodiment of the electrical components of a lighting device 1100 will be discussed in greater detail. As in the embodiment presented in FIG. 10, the lighting device 1100 may include a controller 1110 and a power circuit 1120. In the present embodiment, each of the plurality of lighting structures 1140 may comprise a sub-controller 1150. More specifically, each sub-controller 1150 of the plurality of lighting structures 1140 may be configured to be positioned in electrical communication with the controller 1110 and to receive instructions therefrom. Moreover, each sub-controller 1150 may be configured to operate the plurality of LEDs 221 of the associated lighting structure, one of the first lighting structure 1141, the second lighting structure 1142, or the $n^{th}$ lighting structure 1143, responsive to the instructions received from the controller 1110. In this way, a less sophisticated electrical electronic controller device may be utilized as controller 1110, as it need only communicate and instruction to each sub-controller 1150, which may then interpret the instruction to operate an associated plurality of LEDs according to the configuration of the sub-controller 1150.

Figure 12:
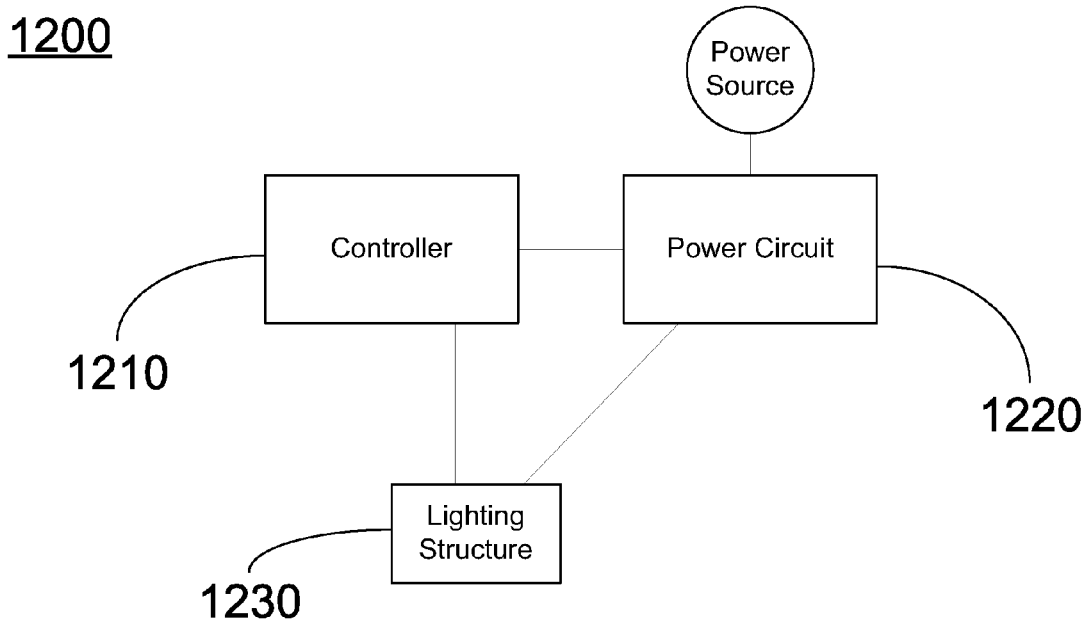
FIG. 12 is a schematic representation of a lighting device according to another embodiment of the present invention.

Referring now to FIG. 12, a schematic of an alternative embodiment of a lighting device 1200 will now be discussed in greater detail. In the present embodiment, the lighting device 1200 includes a controller 1210, a power circuit 1220, and a single lighting structure 1230. In such an embodiment, the controller 1210 may be configured to control the operation of the lighting structure 1230 as described hereinabove.

Figure 13:
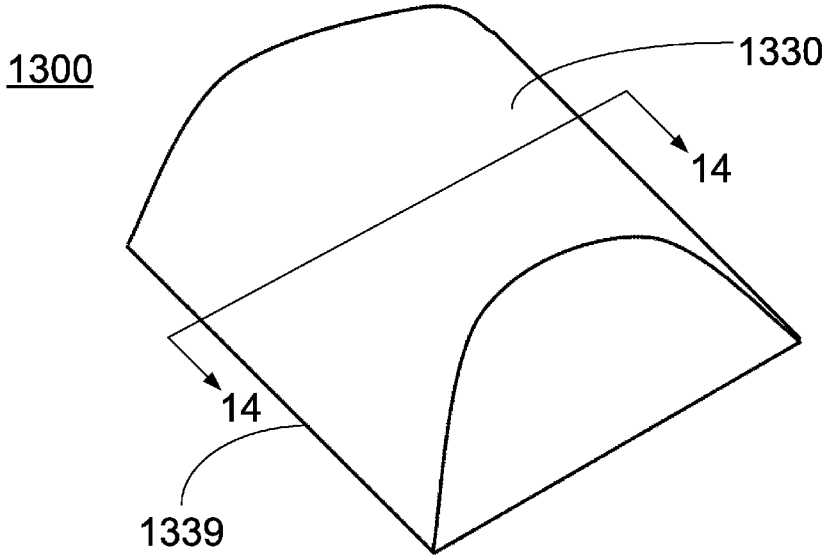
FIG. 13 is a perspective view of a lighting device according to an embodiment of the present invention.
Figure 14:
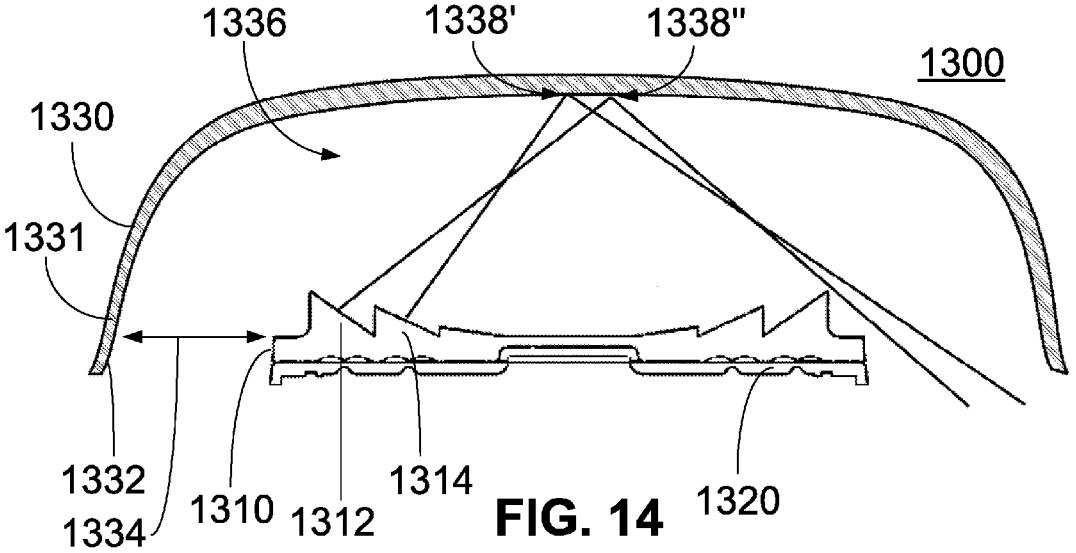
FIG. 14 is a side sectional view of the lighting device of FIG. 13 taken through line 14-14.

Referring now to FIGS. 13 and 14, an alternative embodiment of the invention will now be discussed. In the present embodiment, the lighting device 1300 may include an optic 1310 and a light source structure member 1320 as described hereinabove. Furthermore, the lighting device 1300 may additionally include a reflective housing member 1330. The reflective housing member 1330 may include a wall 1331 having a reflective inner surface 1332 configured to reflect light incident thereupon. Additionally, the reflective inner surface 1332 may be configured to have a contour so as to selectively redirect light that is incident thereupon. In some embodiments, the reflective inner surface 1332 may be configured to redirect light incident thereupon in the direction of a gap 1334 between the reflective housing 1330 and the optic 1310 and the light source structure member 1320 such that light reflected by the reflective inner surface 1332 may propagate into the environment surrounding the lighting device 1300.

Additionally, the reflective housing 1330 may be configured to preserve the directional control of light emitted by the lighting device 1300. Accordingly, the reflective housing 1330 may be configured to redirect light that is incident upon various sections of the reflective inner surface 1332 such that light emitted by a first facet 1312 of the optic 1310 may be emitted from the lighting device 1300 in a first direction, and light emitted by a second facet 1314 of the optic 1310 may be emitted from the lighting device 1300 in a second direction. More specifically, a first facet 1312 of the optic 1310 may emit light that propagates through an optical chamber 1336 defined by the reflective inner surface 1332, is incident upon a first section 1338' of the reflective inner surface 1332, and is redirected through the gap 1334 at an angle and in a direction that is unique indistinguishable from light emitted by the second facet 1314 which is then incident upon a second section 1338" of the reflective inner surface 1332 and redirected through the gap 1334. Accordingly, light may be emitted from any facet of the optic 1310, reflected by the reflective inner surface 1332, and emitted from the lighting device 1300 in a spotlight-like configuration as described hereinabove.

Additional details regarding the lighting device 1300 will now be discussed. The geometric configuration of the reflective housing 1330 may be determined based on the geometric configuration of the optic 1310. More specifically, where the optic 1310 has a generally square configuration, the reflective housing 1330 may similarly have a generally square configuration, whereby a lower edge 1339 of the reflective housing 1330 defines its shape.

In some embodiments, the reflective housing 1330 may include a color conversion layer positioned adjacent to the reflective inner surface 1332 such that light emitted by the optic 1310 is received by the color conversion layer and a converted light is emitted thereby prior to being reflected out of the lighting device 1300. The color conversion layer may be the substantially the same as color conversion layers described hereinabove.

Figure 15:
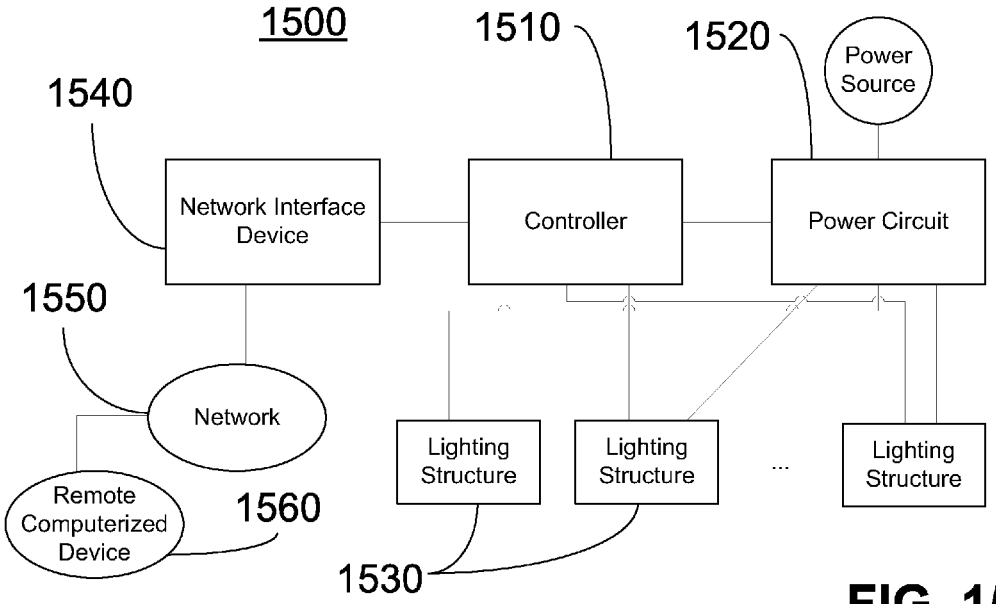
FIG. 15 is a schematic representation of a lighting device according to another embodiment of the present invention.

Referring now to FIG. 15 and alternative embodiment of the invention will now be discussed in detail. In the present embodiment, a lighting device 1500 may comprise a controller 1510, a power circuit 1520, a plurality of lighting structures 1530, and a network interface device 1540. The network interface device 1540 may be positioned in electrical communication with the controller 1510 and may be configured to transmit an instruction to the controller 1510. Additionally, the network interface device 1540 may be configured to communicate electronically with a network 1550. The network 1550 may be any type of computerized network as is known in the art. The network interface device 1540 may be configured to receive an instruction from a remote computerized device 1560 across the network 1550. The network interface device 1540 may be configured to then transmit the instruction to the controller 1510. The controller 1510 may be configured to operate the plurality of lighting structures 1530 responsive to the instructions received from the network interface device 1540. The instruction may cause the controller 1510 to operate a light source of the plurality of light sources associated with a lighting structure 1530 of the plurality of lighting structures 1530.

Figure 16:
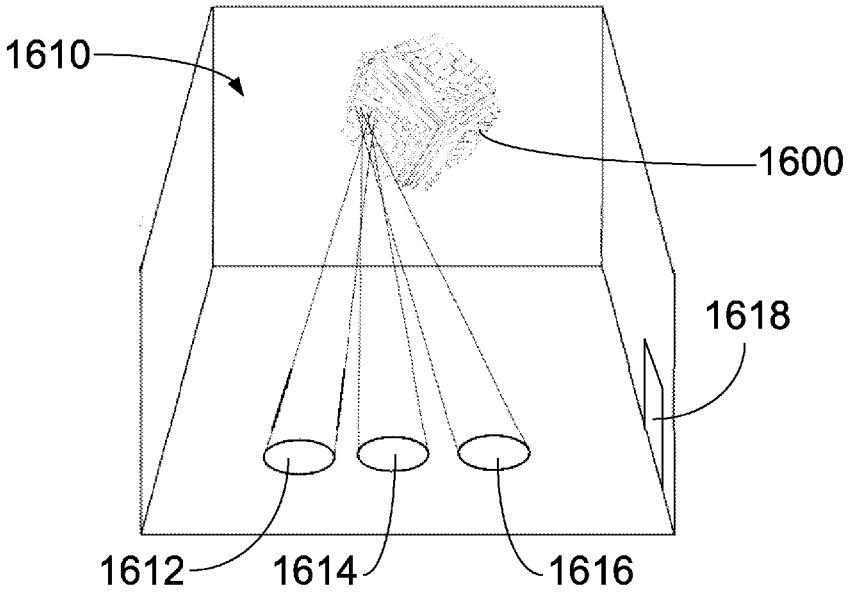
FIG. 16 is an environmental view of a lighting device according to an embodiment of the present invention installed in a room.

Referring now to FIG. 16, an additional aspect of the invention will now be discussed. In the present embodiment, the lighting device 1600 may be positioned so as to emit light into a room 1610. The lighting device 1600 may be configured according to any of the lighting devices described hereinabove. More specifically, the lighting device 1600 may be configured to communicate across the network 1550 as described in the lighting device represented in FIG. 15. Accordingly, the lighting device 1600 may operate responsive to an input received across the network 1550.

One method of using the lighting device 1600 may be to indicate a location within the room 1610. For example, the lighting device 1600 may be operated so as to illuminate a first location 1612 within the room 1610. This may be accomplished by operating a single LED of a plurality of LEDs of the lighting device 1600, which may result in light being emitted from a single facet of the lighting device 1600 as described hereinabove. The light emitted by the single facet may result in light propagating through a volume of the room 1610 and being incident upon the first location 1612. In this way, the lighting device 1600 may indicate to an observer the first location 1612. The purpose of such an indication of the first location 1612 may depend entirely upon the intended use by the user. For example, in some embodiments, where the room 1610 is contained within a retail commercial establishment, the first location 1612 may indicate the location of a particular good. In some embodiments, the first location 1612 may indicate the location of a good that has run out of stock and requires restocking.

Furthermore, the lighting device 1600 may be operated so as to illuminate a second location 1614 within the room 1610. The illumination of the second location 1614 may be concurrent with the illumination of the first location 1612, or they may occur in a sequential fashion. Similarly, the lighting device 1600 may be operated so as to illuminate a third location 1616 within the room 1610. The illumination of the third location 1616 may be concurrent with the illumination of each or either of the first location 1612 and the second location 1614, or it may occur in a sequential illumination of each of the first, second, and third locations 1612, 1614, 1616. In this manner, the lighting device 1600 may indicate a motion of direction by the sequential illumination of the first, second, and third locations 1612, 1614, 1616. This may indicate a suggested direction of travel to an observer. This may be desirable in a retail shopping setting, where the lighting device 1600 may indicate the direction in which an observer may travel in order to find a particular location or good. Additionally, this may be desirable in emergency situations, where the lighting device 1600 may indicate a safe direction of travel towards an exit 1618 of the room 1610.

The above-mentioned scenarios are exemplary only, and the lighting device 1600 may be used in any method, manner, or setting in which directional illumination is desirable. More information regarding lighting scenarios may be found in U.S. patent application Ser. No. 13/464,345 entitled Occupancy Sensor and Associated Methods filed May 4, 2012, U.S. patent application Ser. No. 13/785,652 entitled Occupancy Sensor and Associated Methods filed Mar. 5, 2013, and U.S. patent application Ser. No. 13/403,531 entitled Configurable Environmental Condition Sensing Luminaire, System and Associated Methods filed Feb. 23, 2012, the contents of which are incorporated in their entirety by reference herein.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. An optic for emitting light in selective directions comprising:

a receiving section having a receiving surface;

an intermediate section; and a concave arcuate emitting section comprising a plurality of triangular prism shaped facets;

wherein the triangular prism shaped facets are defined by a rectangular shaped lower surface proximal to the receiving section and an opposing rectangular shaped upper surface distal to the receiving section and formed at an angle relative to the lower surface;

wherein at least two edges of the rectangular shaped lower surface are adjoined by edges of a separate triangular prism shaped facet;

wherein the rectangular shaped upper surfaces are defined by increasing slopes from the optic center;

wherein the rectangular shaped upper surfaces are configured so as to define the concavity of the concave arcuate emitting section;

wherein the receiving surface is configured to direct light incident thereupon through the intermediate section to a triangular prism shaped facet of the concave arcuate emitting section;

wherein each triangular prism shaped facet of the plurality of triangular prism shaped facets is configured to redirect light received from the receiving surface; and wherein substantially each triangular prism shaped facet of the plurality of triangular prism shaped facets is configured to redirect light in a direction unique from the other triangular prism shaped facets of the plurality of triangular prism shaped facets.

2. The optic of claim 1 wherein the intermediate section comprises a plurality of collimating sections; and wherein each collimating section of the plurality of collimating sections is associated with a respective triangular prism shaped facet of the plurality of triangular prism shaped facets.

3. The optic of claim 1 wherein each triangular prism shaped facet is positioned at some distance from a center of the optic; wherein triangular prism shaped facets generally nearer to the center are configured to redirect light in a direction that is generally closer to orthogonal to a plane defined by a section of the receiving surface from which light is directed so as to be incident upon the triangular prism shaped facet; and wherein triangular prism shaped facets generally further from the center are configured to redirect light in a direction that is generally further from orthogonal to a plane defined by a section of the receiving surface from which light is directed so as to be incident upon the triangular prism shaped facet.

4. The optic of claim 1 wherein each triangular prism shaped facet of the plurality of triangular prism shaped facets is configured to be independently illuminated with respect to other adjacent triangular prism shaped facets.

5. The optic of claim 1 wherein two triangular prism shaped facets are configured to be independently illuminated with respect to other adjacent triangular prism shaped facets.

6. The optic of claim 1 wherein all triangular prism shaped facets are configured to be illuminated as a monolithic unit.

7. The optic of claim 6 wherein each facet is configured to redirect light so as to form a single combined light.

8. The optic of claim 1 wherein the receiving surface is generally planar.

9. A lighting device for emitting light in selective directions comprising:

a first light source structure member having an outer surface;

a first plurality of light sources attached to the outer surface of the light source structure member;

a controller functionally coupled to the first plurality of light sources;

a power supply positioned in electrical communication with at least one of the controller and the first plurality of light sources; and a first optic having a receiving section comprising a receiving surface, an intermediate section, and a concave arcuate emitting section, the concave arcuate emitting section comprising a plurality of triangular prism shaped facets, and the first optic being carried by the first light source structure member;

wherein the triangular prism shaped facets are defined by a rectangular shaped lower surface proximal to the receiving section and an opposing rectangular shaped upper surface distal to the receiving section and formed at an angle relative to the lower surface;

wherein at least two edges of the rectangular shaped lower surface are adjoined by edges of a separate triangular prism shaped facet;

wherein the rectangular shaped upper surfaces are defined by increasing slopes from the optic center;

wherein the rectangular shaped upper surfaces are configured so as to define the concavity of the concave arcuate emitting section;

wherein each light source of the first plurality of light sources is positioned such that light emitted thereby is received by the receiving surface, directed through the intermediate section, and emitted through a triangular prism shaped facet of the plurality of triangular prism shaped facets of the first optic;

wherein each triangular prism shaped facet of the plurality of triangular prism shaped facets is configured to redirect light in a direction unique from the other triangular prism shaped facets of the plurality of triangular prism shaped facets; and wherein the controller is configured to selectively operate each light source of the first plurality of light sources.

10. The lighting device of claim 9 wherein the intermediate section comprises a plurality of collimating sections; wherein each collimating section of the plurality of collimating sections is associated with a triangular prism shaped facet of the plurality of triangular prism shaped facets; and wherein each collimating section is configured to collimate light in the direction of the associated triangular prism shaped facet emitted by a light source of the first plurality of light sources.

11. The lighting device of claim 9 wherein the first plurality of light sources comprises a light-emitting diode.

12. The lighting device of claim 9 wherein the outer surface is configured to be planar such that the first plurality of light sources are positioned thereupon so as to be coplanar; wherein the receiving surface is generally planar; and wherein the receiving surface is positioned so as to be generally parallel to a plane defined by the first plurality of light sources.

13. The lighting device of claim 9 wherein each triangular prism shaped facet is singularly associated with a single light source of the first plurality of light sources.

14. The lighting device of claim 9 wherein two or more triangular prism shaped facets are associated with a single light source of the first plurality of light sources.

15. The lighting device of claim 9 wherein each triangular prism shaped facet is associated with two or more light sources of the first plurality of light sources.

16. The lighting device of claim 15 wherein each of the two or more light sources associated with each triangular prism shaped facet emit light that combines to form a combined light; and wherein the combined light is a white light.

17. The lighting device of claim 9 further comprising:

a second light source structure member having an outer surface;

a second plurality of light sources positioned on the second light source structure member; and a second optic having a receiving section comprising a generally planar receiving surface, an intermediate section, and an emitting section, the emitting section comprising a plurality of triangular prism shaped facets;

wherein each light source of the second plurality of light sources is positioned such that light emitted thereby is received by the receiving surface, directed through the intermediate section, and emitted through a triangular prism shaped facet of the plurality of triangular prism shaped facets of the second optic;

wherein each triangular prism shaped facet of the plurality of triangular prism shaped facets of the second optic is configured to redirect light in a direction unique from the other triangular prism shaped facets of the plurality of triangular prism shaped facets of the second optic;

wherein the power supply is positioned in electrical communication with at least one of the controller, the first plurality of light sources, and the second plurality of light sources;

wherein the controller is configured to selectively operate each light source of the first and second plurality of light sources;

wherein the receiving surface of the first optic defines a first plane, and the receiving surface of the second optic defines a second plane; and wherein the first plane is skew to the second plane.

18. The lighting device of claim 17 wherein a section of the first light source structure member interfaces with a section of the second light source structure member.

19. The lighting device of claim 17 wherein the first plane is perpendicular to the second plane.

20. A lighting device for emitting light in selective directions comprising:

a plurality of lighting structures, each lighting structure of the plurality of lighting structures comprising:

a light source structure member having an outer surface and an inner surface;

a plurality of light sources attached to the outer surface of the light source structure member; and an optic comprising a receiving section comprising a receiving surface, an intermediate section, and a concave arcuate emitting section, the concave arcuate emitting section comprising a plurality of triangular prism shaped facets, the optic being carried by the light source structure member adjacent to the outer surface; and a controller functionally coupled to the plurality of light sources of each of the lighting structures of the plurality of lighting structures;

a power supply positioned in electrical communication with at least one of the controller and the plurality of light sources of the plurality of lighting structures;

wherein the triangular prism shaped facets are defined by a rectangular shaped lower surface proximal to the receiving section and an opposing rectangular shaped upper surface distal to the receiving section and formed at an angle relative to the lower surface;

wherein at least two edges of the rectangular shaped lower surface are adjoined by edges of a separate triangular prism shaped facet;

wherein the rectangular shaped upper surfaces are defined by increasing slopes from the optic center;

wherein the rectangular shaped upper surfaces are configured so as to define the concavity of the concave arcuate emitting section;

wherein the plurality of lighting structures are positioned such that the inner surface of each light source structure member cooperates to define an internal cavity;

wherein the controller is configured to selectively operate each light source of the plurality of light sources of each lighting structure;

wherein each light source of the plurality of light sources of each lighting structure is positioned such that light emitted thereby is received by the receiving surface of the same lighting structure, directed through the intermediate section, and emitted through a triangular prism shaped facet of the plurality of triangular prism shaped facets of the optic of the same lighting structure; and wherein each triangular prism shaped facet of the plurality of triangular prism shaped facets of each lighting structure is configured to redirect light in a direction unique from the other facets of the plurality of facets of the same lighting structure.

21. The lighting device of claim 20 wherein each lighting structure of the plurality of lighting structures has the same geometry; and wherein the plurality of lighting structures are positioned so as to form a regular polyhedral shape.

* * * * *